US009251972B2

(12) United States Patent
Belloni et al.

(10) Patent No.: US 9,251,972 B2
(45) Date of Patent: Feb. 2, 2016

(54) ELECTRIC SWITCHING DEVICE AND RELATED ELECTRIC APPARATUS

(71) Applicant: ABB Technology AG, Zürich (CH)

(72) Inventors: Francesco Belloni, Bergamo (IT); Pierino Bertolotto, Bergamo (IT)

(73) Assignee: ABB TECHNOLOGY AG, Zurich (CH)

( * ) Notice: Subject to any disclaimer, the term of this patent is extended or adjusted under 35 U.S.C. 154(b) by 163 days.

(21) Appl. No.: 13/850,776

(22) Filed: Mar. 26, 2013

(65) Prior Publication Data

US 2013/0248338 A1 Sep. 26, 2013

(30) Foreign Application Priority Data

Mar. 26, 2012 (EP) ..... 12161169

(51) Int. Cl.

| | |
|---|---|
| ***H01H 9/02*** | (2006.01) |
| ***H01H 33/662*** | (2006.01) |
| ***H01H 33/666*** | (2006.01) |
| ***H01H 33/02*** | (2006.01) |

(52) U.S. Cl.

CPC ..... *H01H 9/02* (2013.01); *H01H 33/6661* (2013.01); *H01H 33/66207* (2013.01); *H01H 33/022* (2013.01); *H01H 33/027* (2013.01); *H01H 2033/6623* (2013.01); *H01H 2033/6667* (2013.01)

(58) Field of Classification Search

CPC ..... H01H 9/02; H01H 2009/0292; H01H 31/003; H01H 33/022; H01H 33/56; H01H 2033/568; H01H 9/40; H01H 33/66; H01H 33/666; H01H 33/6661

USPC ..... 218/118, 154, 12, 45; 200/5 A

See application file for complete search history.

(56) References Cited

U.S. PATENT DOCUMENTS

| | | | | |
|---|---|---|---|---|
| 4,541,033 | A * | 9/1985 | Saito | 361/602 |
| 8,642,912 | B2 * | 2/2014 | Lee | 218/120 |

(Continued)

FOREIGN PATENT DOCUMENTS

| | | |
|---|---|---|
| DE | 10 2007 042 041 B3 | 2/2009 |
| DE | 20 2010 005 246 U1 | 9/2010 |

(Continued)

OTHER PUBLICATIONS

European Search Report dated Aug. 29, 2012.

*Primary Examiner* — Renee Luebke
*Assistant Examiner* — William Bolton
(74) *Attorney, Agent, or Firm* — Buchanan Ingersoll & Rooney PC

(57) ABSTRACT

An electric switching device for an electric circuit, including at least one electric phase having at least one circuit breaking unit associated with a disconnector unit. The circuit breaker unit including a circuit breaker movable contact configured to be actuated between a closed position and an open position with respect to a corresponding circuit breaker fixed contact. The disconnector unit includes at least one disconnector movable contact configured to be actuated between a connection position and a disconnection position with respect to a corresponding disconnector fixed contact. A casing that includes an insulating shell coupled to a metal shell. The casing houses at least the circuit breaker unit and the associated disconnector unit of said at least one electric phase.

18 Claims, 16 Drawing Sheets

(56) References Cited

U.S. PATENT DOCUMENTS

| | | | | |
|---|---|---|---|---|
| 2004/0104201 | A1 | 6/2004 | Sato et al. | |
| 2005/0150869 | A1 | 7/2005 | Vaghini et al. | |
| 2007/0151953 | A1* | 7/2007 | Meinherz | 218/155 |
| 2008/0110738 | A1* | 5/2008 | Vaghini et al. | 200/48 V |
| 2011/0155547 | A1* | 6/2011 | Cortinovis et al. | 200/16 A |
| 2012/0261384 | A1* | 10/2012 | LaBianco et al. | 218/118 |

FOREIGN PATENT DOCUMENTS

| | | | |
|---|---|---|---|
| EP | 1 226 596 | B1 | 1/2003 |
| EP | 1 538 650 | A2 | 6/2005 |
| EP | 1 928 065 | A1 | 6/2008 |

* cited by examiner

ELECTRIC SWITCHING DEVICE AND RELATED ELECTRIC APPARATUS

RELATED APPLICATION(S)

This application claims priority under 35 U.S.C. §119 to European Patent Application No. 12161169.3 filed in Europe on Mar. 26, 2012, the entire content of which is hereby incorporated by reference in its entirety.

FIELD

The present disclosure relates to a switching device and a related electric apparatus.

BACKGROUND INFORMATION

Known switching devices are designed to allow the correct operation of specific parts of the electric circuits in which they are installed, and of the operators of such electric circuits.

Circuit breakers are known switching devices which perform a protective function against failures occurring in the associated electric circuit. For example, a circuit breaker can be actuated, during its operation, between a closed position, where it allows a current flowing between two parts of the associated electric circuit, and an open position where it interrupts such current flow. Thus, the circuit breakers can be suitable for interrupting fault currents, e.g. an overload or short-circuit current.

Disconnectors are known switching devices which perform a disconnecting function between two parts of the associated electric circuit, to ensure the safety of the operators working on one of the two disconnected parts. A disconnector can be actuated, during its operation, between a connection position, where an electrical connection between the two parts is realized by the disconnector itself, and a disconnection position, where the two parts are physically separated by the disconnector itself in order to interrupt their electrical connection.

As the circuit breaker, the disconnector in the connection position can withstand the flowing therethrough of fault currents but, contrary to the circuit breaker, it cannot be actuated to interrupt such fault currents. Hence, a circuit breaker and a disconnector can be associated in each phase of an electric circuit, and can be connected in series to perform the current interruption functionality between two parts of the electric circuit and the disconnection functionality between such two parts, respectively.

Under normal operation conditions, a current flows between the two parts of the electric circuit through the current path realized by the circuit breaker in the closed position and the disconnector in the connection position. The disconnector can be actuated from the connection to the disconnection position only after that the circuit breaker has been actuated from the closed to the open position.

The circuit breakers and the associated disconnectors are installed in an electric unit, such as a switchgear. The electric unit includes a distribution compartment containing power distribution means, e.g. distribution bars, and a load compartment containing cables (or other connection means) connected to one or more electric loads.

The distribution means and the corresponding one or more electric loads are operatively electrically connected through the circuit breakers and the associated disconnectors. For example, the circuit breakers and the disconnectors are located into the electric unit between the distribution and load compartments.

In some applications a metal earthed segregation between the distribution and load compartments is specified.

The circuit breakers and the associated disconnectors are conceived as separated devices, e.g., each having an own casing occupying a dedicated space, or comportment, into the electric unit. In this case, further internal space of the electric unit has to be occupied by connection means provided for electrically connecting the associated circuit breakers and disconnectors (placed at difference locations into the electric unit).

In this example the above mentioned metal earthed segregation can be fulfilled by making the casing of the disconnectors entirely of metal material.

European patent application EP1928065 discloses a disconnector unit having a casing defined by coupling a first insulating shell and a second metal shell, wherein the metal earthed segregation is fulfilled by the metal shell.

In other known solutions, the associated circuit breakers and disconnectors are housed into the same casing, or tank, which is entirely made of metal material in order to provide the metal earthed segregation.

At the current state of the art, although known solutions perform in a rather satisfying way, there is still reason and desire for further improvements.

Exemplary embodiments described herein provide an electric switching device for an electric circuit, having at least an electric phase that includes at least a circuit breaking unit associated with a disconnector unit, wherein the circuit breaker unit has at least a circuit breaker movable contact which can be actuated, during the operation of the circuit breaker unit, between a closed position where it is electrically coupled to a corresponding circuit breaker fixed contact and an open position where it is electrically separated from the corresponding circuit breaker fixed contact, and wherein the disconnector unit includes at least a disconnector movable contact which can be actuated, during the operation of the disconnector unit, between a connection position where it is connected to a corresponding disconnector fixed contact and at least a disconnection position where it is disconnected from the corresponding disconnector fixed contact, a casing including a first shell made of insulating material coupled to a second shell made of metal material, said casing housing at least the circuit breaker unit and the associated disconnector unit of said at least an electric phase.

In another exemplary embodiment of the present disclosure an electric apparatus including a switching device such as the switching device defined by the annexed claims and disclosed in the following description, a first operating mechanism operatively connected to and adapted to drive the first actuating means of the switching device to cause the actuation of said at least circuit breaker movable contact of the circuit breaker unit, a second operating mechanism operatively connected to and adapted to drive the second actuating means of the switching device to cause the actuation of said at least a disconnector movable contact of the disconnector unit, interlocking means operatively connected to the first and second operating mechanisms and adapted to avoid (e.g., prevent) the driving of said second actuating means by the second operating mechanism, when said at least a circuit breaker movable contact is in the closed position.

Another exemplary embodiment of the present disclosure provides a switchgear including at least a switching device and/or at least an electric apparatus such as the switching device and the electrical apparatus defined by the annexed claims and disclosed in the following description.

In the following description reference will be made for example to an exemplary electrical switching device, an exemplary electric apparatus and an exemplary switchgear suitable for being used in medium voltage applications, wherein for the purpose of the present disclosure the term "medium voltage" is referred to applications with operating voltages in the range from 1 kV to some tens of kV, e.g., 30 kV or 40 kV.

It is to be set forth that the switching device, the electric apparatus and the switchgear according to the present disclosure can be used in applications having a greater voltage, e.g. in an applications having a voltage greater than 40 kV.

SUMMARY

An exemplary electric switching device for an electric circuit is disclosed, comprising: at least one electric phase including at least one circuit breaking unit and a disconnector unit associated with said at least one circuit breaking unit, said circuit breaker unit having at least one circuit breaker movable contact which can be actuated between a closed position and an open position, wherein in the closed position the at least one circuit breaker movable contact is electrically coupled to a corresponding circuit breaker fixed contact, and in the open position is electrically separated from said corresponding circuit breaker fixed contact, said disconnector unit having at least one disconnector movable contact which can be actuated between a connection position and a disconnection position, wherein in the connection position the disconnector movable contact is connected to a corresponding disconnector fixed contact, and in the disconnection position is disconnected from said corresponding disconnector fixed contact; and a casing including a first shell made of insulating material coupled to a second shell made of metal material, said casing configured to house at least the circuit breaker unit and the associated disconnector unit of said at least one electric phase.

An electric apparatus is disclosed, comprising: a switching device having: at least one electric phase including at least one circuit breaking unit and a disconnector unit associated with said at least one circuit breaking unit, said circuit breaker unit having at least one circuit breaker movable contact which can be actuated between a closed position and an open position, wherein in the closed position the at least one circuit breaker movable contact is electrically coupled to a corresponding circuit breaker fixed contact and in the open position is electrically separated from said corresponding circuit breaker fixed contact, said disconnector unit having at least one disconnector movable contact which can be actuated between a connection position and a disconnection position, wherein in the connection position the disconnector movable contact is connected to a corresponding disconnector fixed contact and in the disconnection position is disconnected from said corresponding disconnector fixed contact; and a casing including a first shell made of insulating material coupled to a second shell made of metal material, said casing configured to house at least the circuit breaker unit and the associated disconnector unit of said at least one electric phase; first actuating means operatively connected to at least one circuit breaker movable contact for actuating said at least one circuit breaker movable contact; and second actuating means operatively connected to said at least one disconnector movable contact for actuating said at least one disconnector movable contact, wherein said casing houses at least a portion of said first actuating means and at least a portion of said second actuating means; a first operating mechanism operatively connected to and adapted to drive said first actuating means of the switching device to cause the actuation of said at least one circuit breaker movable contact of the circuit breaker unit; a second operating mechanism operatively connected to and adapted to drive said second actuating means of the switching device to cause the actuation of said at least one disconnector movable contact of the disconnector unit; interlocking means operatively connected to said first and second operating mechanisms and adapted to prevent the driving of said second actuating means by the second operating mechanism, when said at least one circuit breaker movable contact is in the closed position.

An exemplary switchgear is disclosed comprising: at least one switching device including at least one electric phase having at least one circuit breaking unit and disconnector unit associated with said at least one circuit breaking unit, said circuit breaker unit having at least one circuit breaker movable contact which can be actuated between a closed position and an open position, wherein in the closed position the at least one circuit breaker movable contact is electrically coupled to a corresponding circuit breaker fixed contact and in the open position is electrically separated from said corresponding circuit breaker fixed contact, said disconnector unit having at least one disconnector movable contact which can be actuated between a connection position and a disconnection position, wherein in the connection position the disconnector movable contact is connected to a corresponding disconnector fixed contact and in the disconnection position is disconnected from said corresponding disconnector fixed contact; and a casing including a first shell made of insulating material coupled to a second shell made of metal material, said casing configured to house at least the circuit breaker unit and the associated disconnector unit of said at least one electric phase.

An exemplary switchgear is disclosed comprising: at least one electric apparatus including a switching device having: at least one electric phase including at least one circuit breaking unit and a disconnector unit associated with said at least one circuit breaking unit, said circuit breaker unit having at least one circuit breaker movable contact which can be actuated between a closed position and an open position, wherein in the closed position the at least one circuit breaker movable contact is electrically coupled to a corresponding circuit breaker fixed contact and in the open position is electrically separated from said corresponding circuit breaker fixed contact, said disconnector unit having at least one disconnector movable contact which can be actuated between a connection position and a disconnection position, wherein in the connection position the disconnector movable contact is connected to a corresponding disconnector fixed contact and in the disconnection position is disconnected from said corresponding disconnector fixed contact; and a casing including a first shell made of insulating material coupled to a second shell made of metal material, said casing configured to have at least the circuit breaker unit and the associated disconnector unit of said at least one electric phase; first actuating means operatively connected to at least one circuit breaker movable contact for actuating of said at least one circuit breaker movable contact; and second actuating means operatively connected to said at least one disconnector movable contact for actuating said at least one disconnector movable contact, wherein said casing houses at least a portion of said first actuating means and at least a portion of said second actuating means; a first operating mechanism operatively connected to and adapted to drive said first actuating means of the switching device to cause the actuation of said at least one circuit breaker movable contact of the circuit breaker unit; a second operating mechanism operatively connected to and adapted to drive said second actuating means of the switching device to cause the actuation of said at least one disconnector movable contact of the disconnector unit; and interlocking means operatively connected to said first and second operating mechanisms and adapted to prevent the driving of said second actuating means by the second operating mechanism, when said at least one circuit breaker movable contact is in the closed position.

BRIEF DESCRIPTION OF THE DRAWINGS

Further characteristics and advantages will be more apparent from the description of exemplary, but non-exclusive, embodiments of an electrical switching device, an electric apparatus and a switchgear according to the present disclosure, illustrated in the accompanying drawings, wherein.

Figure 1:
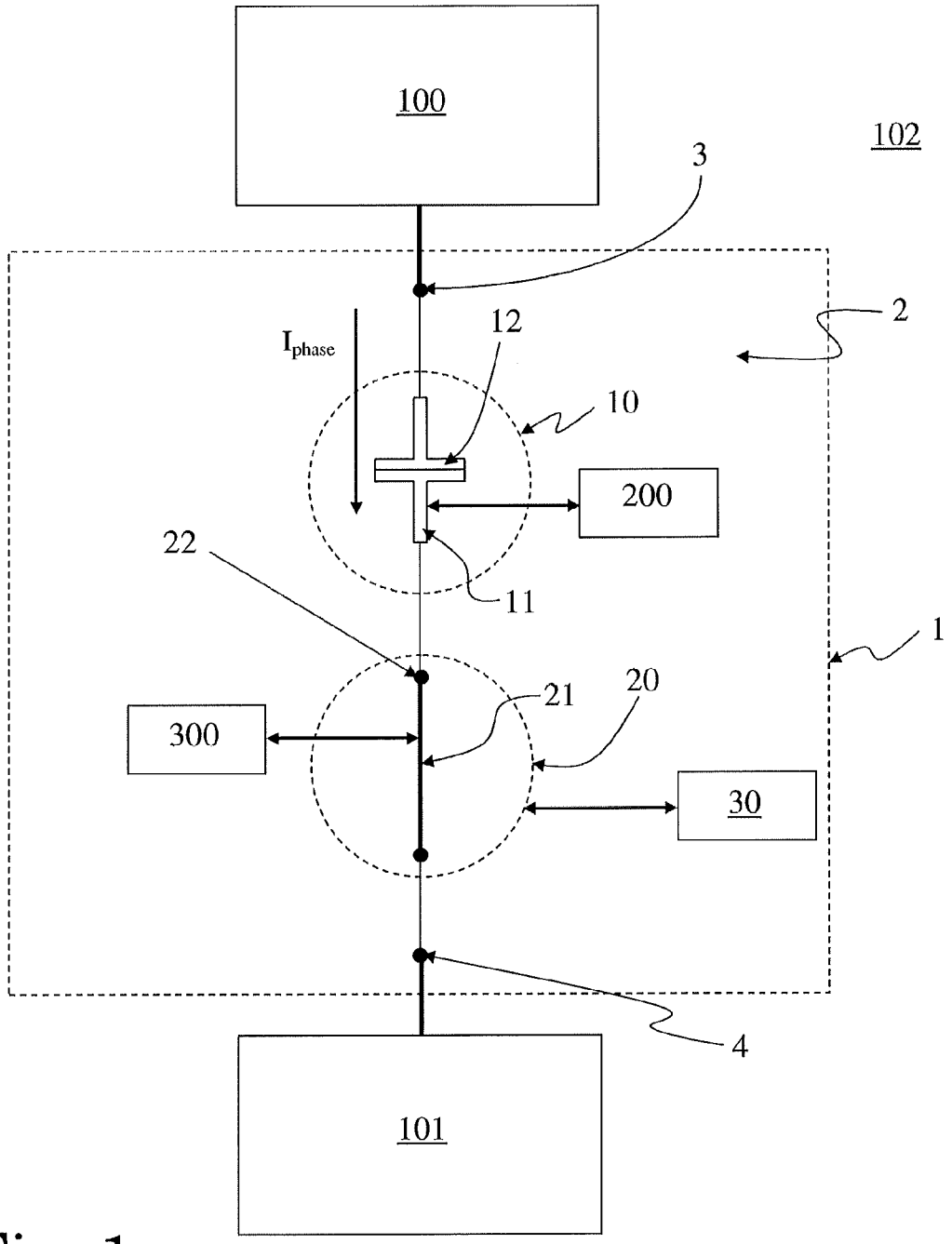
FIG. 1 shows an electric scheme of an electric phase in a switching device in accordance with an exemplary embodiment of the present disclosure.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings can not necessarily be to scale and certain features of the disclosure can be shown in somewhat schematic form.

DETAILED DESCRIPTION

FIG. 1 shows an electric scheme of an electric phase in a switching device in accordance with an exemplary embodiment of the present disclosure. As shown in FIG. 1, an electric switching device 1 suitable for being installed in an electric circuit 102 has one or more electrical phases 2, or poles 2. Each phase 2 operatively electrically connects a first part 100 and a second part 101 of the electric circuit 102 (as shown for example in FIG. 1).

The first part 100 of the electric circuit 102 can be a distribution, or line, part 100 suitable for distributing power, and the second part 101 can be a load part 101 drawing power from the distribution part 101.

In the exemplary embodiments of FIGS. 2-3, 5 and 9 the switching device 1 includes three electrical phases indicated with numeral references 2*a*, 2*b* and 2*c*; it is to be set forth that the switching device 1 can have, according to desired specifications, any number of electric phases 2 different to the illustrated one, e.g. a single electric phase 2, two electric phases 2 or four electric phases 2.

Each electric phase 2 of the switching device 1 can include at least a circuit breaker unit 10 associated with a disconnector unit 20.

For each electric phase 2, the switching device 1 includes at least an electric terminal 3 associated with the circuit breaker unit 10 and suitable for electrically connecting such circuit breaker unit 10 to the first part 100 of the electric circuit 102; and at least an electrical terminal 4 associated with the disconnector unit 20 and suitable for electrically connecting such disconnector unit 20 to the second part 101 of the electric circuit 102.

The circuit breaker unit 10 includes at least a circuit breaker movable contact 11 (hereinafter indicated for sake of simplicity as "movable contact 11") which can be actuated, during the operation of the circuit breaker unit 10 itself, between a closed position where it is electrically coupled to a corresponding circuit breaker fixed contact 12 (hereinafter indicated for sake of simplicity as "fixed contact 12"), and an open position where it is electrically separated from the corresponding fixed contact 12.

With reference to the exemplary embodiment of FIG. 1, for each electric phase 2 the actuation of the movable contact 11 from the open position to the closed position allows the flowing of a current $I_{phase}$ between the first and second parts 100, 101 of the electric circuit 102, through the electrically coupled movable and fixed contacts 11, 12.

The actuation of the movable contact 11 from the closed position to the open position causes the interruption of such current $I_{phase}$ by means of the electrical separation between the movable and fixed contacts 11, 12. Such actuation can be caused by a manual intervention of an operator, or automatically (by means of actuators) at the occurrence of an electric fault, e.g. an overload or a short-circuit.

The disconnector unit 20 includes at least a movable disconnector contact 21 (hereinafter indicated for sake of simplicity as "movable contact 21") which can be actuated, during the operation of the disconnector unit 20 itself, between a connection position where it is connected to a corresponding disconnector fixed contact 22 (hereinafter indicated for sake of simplicity as "fixed contact 22"), and at least a disconnection position where it is disconnected from the corresponding fixed contact 22.

In the exemplary embodiment shown in FIG. 1, the connection between the movable and fixed contacts 21, 22 is suitable for realizing an electrical connection between the first and second parts 100, 101 of the electric circuit 102. The actuation of the movable contact 21 from the connection position to the disconnection position causes a physical separation between the first and second parts 100, 101 (in order to interrupt the electrical connection between them).

The circuit breaker unit 10 and the disconnector unit 20 of the electric phase 2 can be connected in series between the first and second parts 100, 101 of the electric circuit 102, as illustrated for example in FIG. 1.

As shown in FIG. 1, the fixed contact 12 of the circuit breaker unit 10 is connected to the electric terminal 3, the movable contact 11 is connected to the fixed contact 22 of the disconnector unit 20, and the movable contact 21 is connected to the electric terminal 4.

Alternatively, the movable contact 11 of the circuit breaker unit 10 can be connected to the electric terminal 3 and the corresponding fixed contact 12 to the disconnector unit 20, and/or the fixed contact 22 of the disconnector unit 20 can be connected to the electrical terminal 4 and the corresponding movable contact 21 to the circuit breaker unit 10.

In exemplary embodiments of the disclosure under normal operation conditions of the switching device 1, for each electric phase 2 the current $I_{phase}$ flows between the first and second parts 100, 101 through the current path realized by the electrically coupled movable and fixed contacts 11, 12 of the circuit breaker unit 10 and by the connected movable and fixed contacts 21, 22 of the disconnector unit 20.

After that the movable contact 11 of the circuit breaker unit 10 has been actuated from the closed to the open position to interrupt the current $I_{phase}$, the movable contact 21 of the disconnector unit 20 can be also actuated from the connection position to the disconnection position to provide a further physical interruption in the electrical connection between the first and second parts 100, 101.

In an exemplary embodiment of the present disclosure, the switching device 1 has a casing 50 advantageously including a first shell made 51 made of insulating material (hereinafter indicated for sake of simplicity as "insulating shell 51") which is coupled to a second shell 52 made of metal material (hereinafter indicated for sake of simplicity as "metal shell 52").

The casing 50 houses at least the circuit breaker unit 10 and the associated disconnector unit 20 of each electrical phase 2 in the switching device 1.

According to another exemplary embodiment, the insulating shell 51 and the metal shell 52 are coupled in a gas-tight manner. The casing 50 defined by such gas-tight coupling can be filled with insulating gas, such as for example $SF_6$; alternatively, in applications for smaller voltages, the gas-tight casing 50 can be filled with air.

Figure 2:
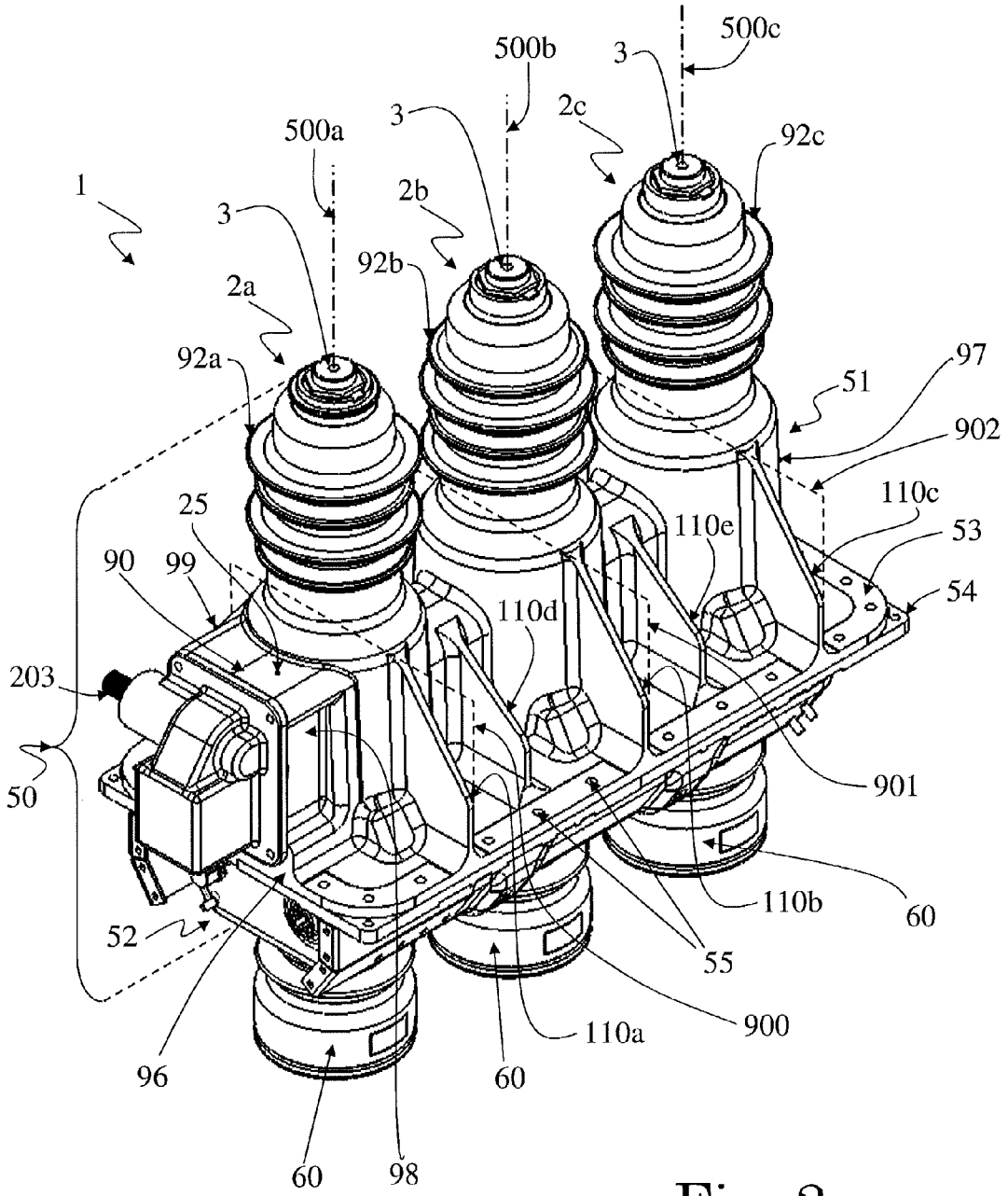
FIG. 2 is a perspective view of a switching device in accordance with an exemplary embodiment of the present disclosure.
Figure 3:
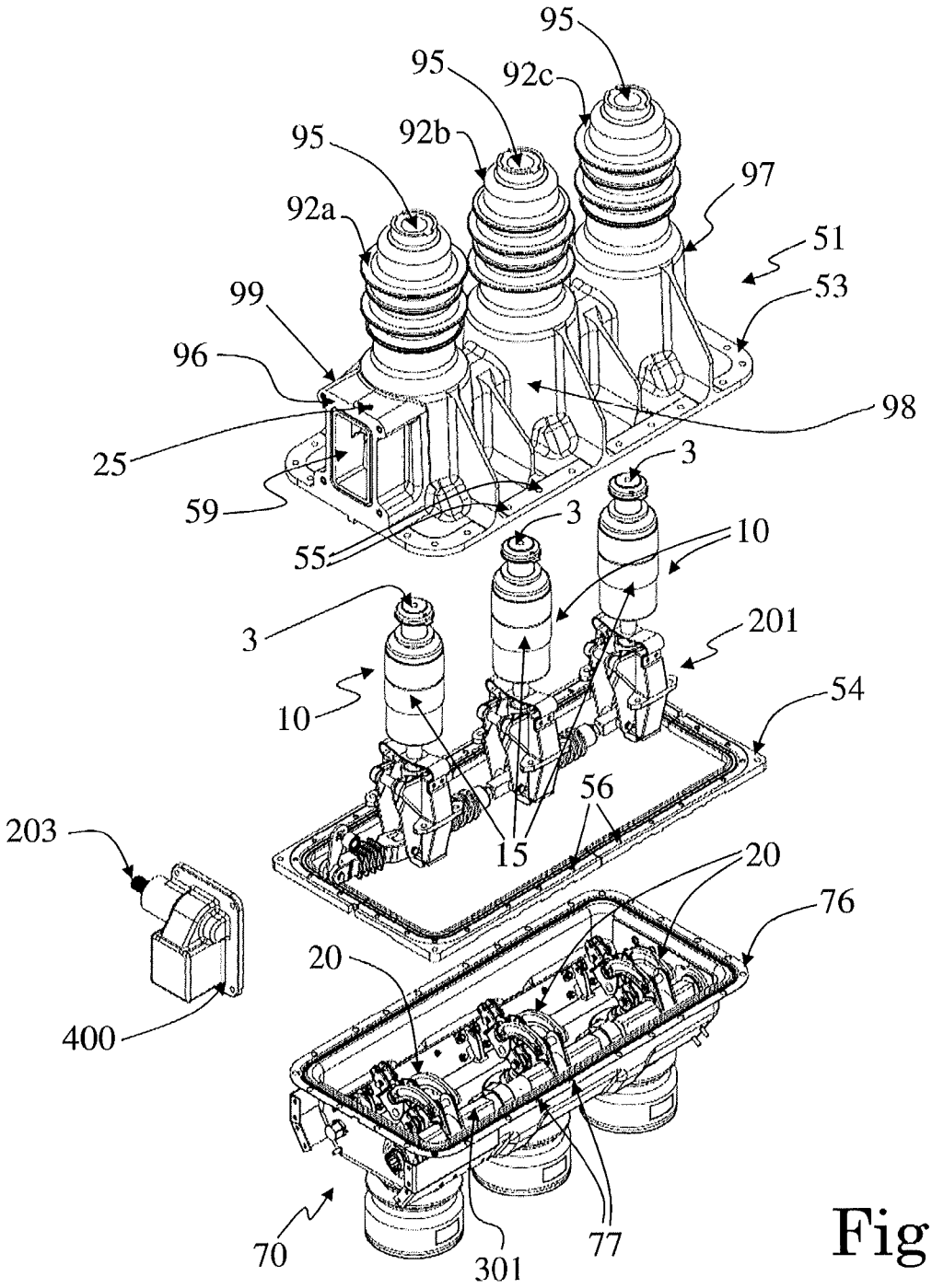
FIG. 3 is an exploded view of the components of the switching device of FIG. 2 in accordance with an exemplary embodiment of the present disclosure.
Figure 4:
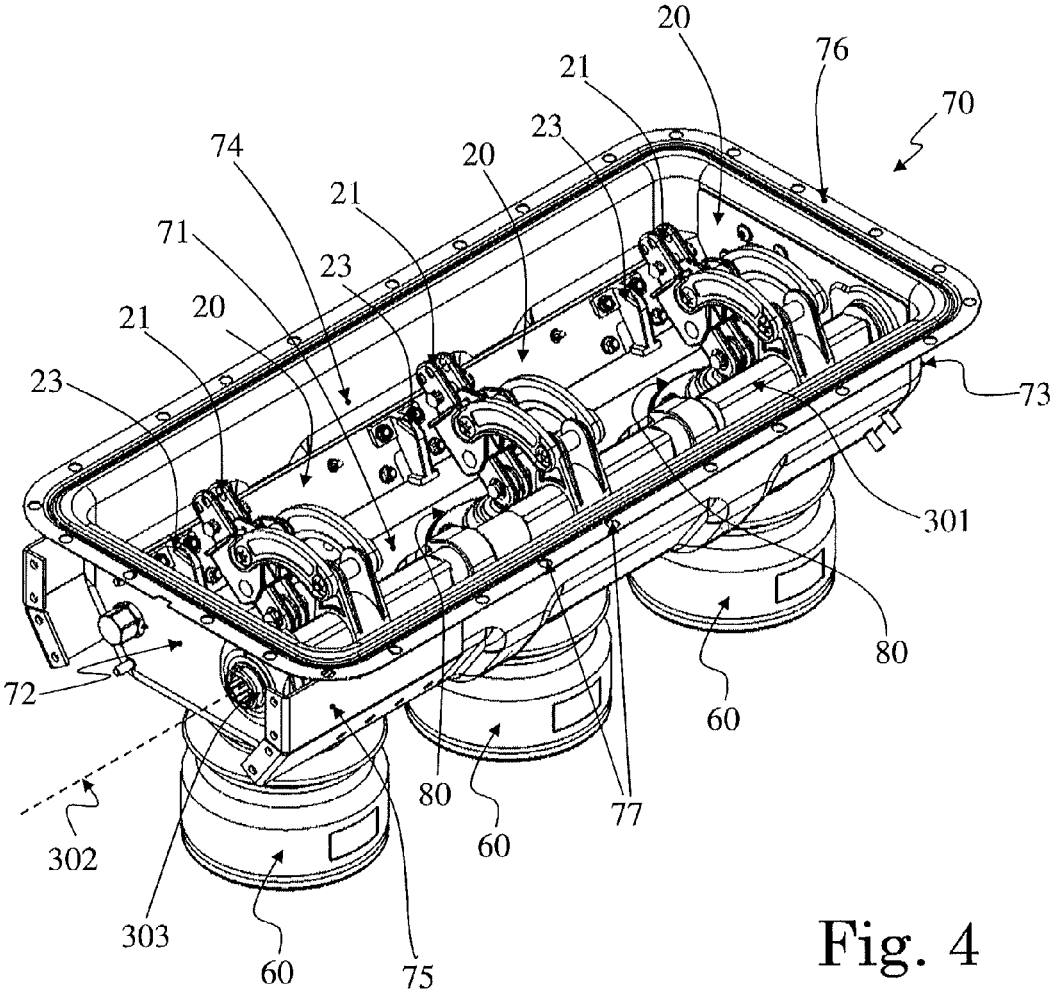
FIG. 4 is a perspective view of the metal shell of the switching device of FIG. 2 in accordance with an exemplary embodiment of the present disclosure.

FIG. 2 is a perspective view of a switching device in accordance with an exemplary embodiment of the present disclosure. FIG. 3 is an exploded view of the components of the switching device of FIG. 2 in accordance with an exemplary embodiment of the present disclosure. FIG. 4 is a perspective view of the metal shell of the switching device of FIG. 2 in accordance with an exemplary embodiment of the present disclosure. As shown in FIGS. 2-4, the insulating shell 51 and the metal shell 52 include a flanged portion, respectively indicated with numeral references 53 and 54; such flanged portions 53, 54 are suitable for realizing the mutual coupling between the first and metal shells 51, 52. For example, the flanged portions 53 and 54 can include one or more seats for sealing means, such as gaskets, and can be provided with coupling and fixing means for keeping the insulating and metal shells 51, 52 joined in a gas-tight manner.

The insulating shell 51 can be made for example of polymeric material (e.g. a thermoplastic or a thermosetting material). Among the thermosetting polymers, epoxy resin or polyester can be cited for example. In case of outdoor installation of the switching device 1 (e.g., when the switching device 1 is placed on air and not into a dedicate housing and/or electric unit), the insulating shell 51 can be entirely made or include at least a covering layer of a polymeric material that is resistant to the external environment, e.g. epoxy cycloaliphatic resin or silicon coated material.

The metal shell 52 can be made for example of steel, such as stainless steel or pre-galvanized steel.

The electric terminals 3 and 4 of each electric phase 2 protrude outside from the casing 50 for connecting the associated circuit breaker unit 10 and disconnector unit 20, respectively, to the first part 100 and the second part 101 of the electric circuit 102.

Figure 5:
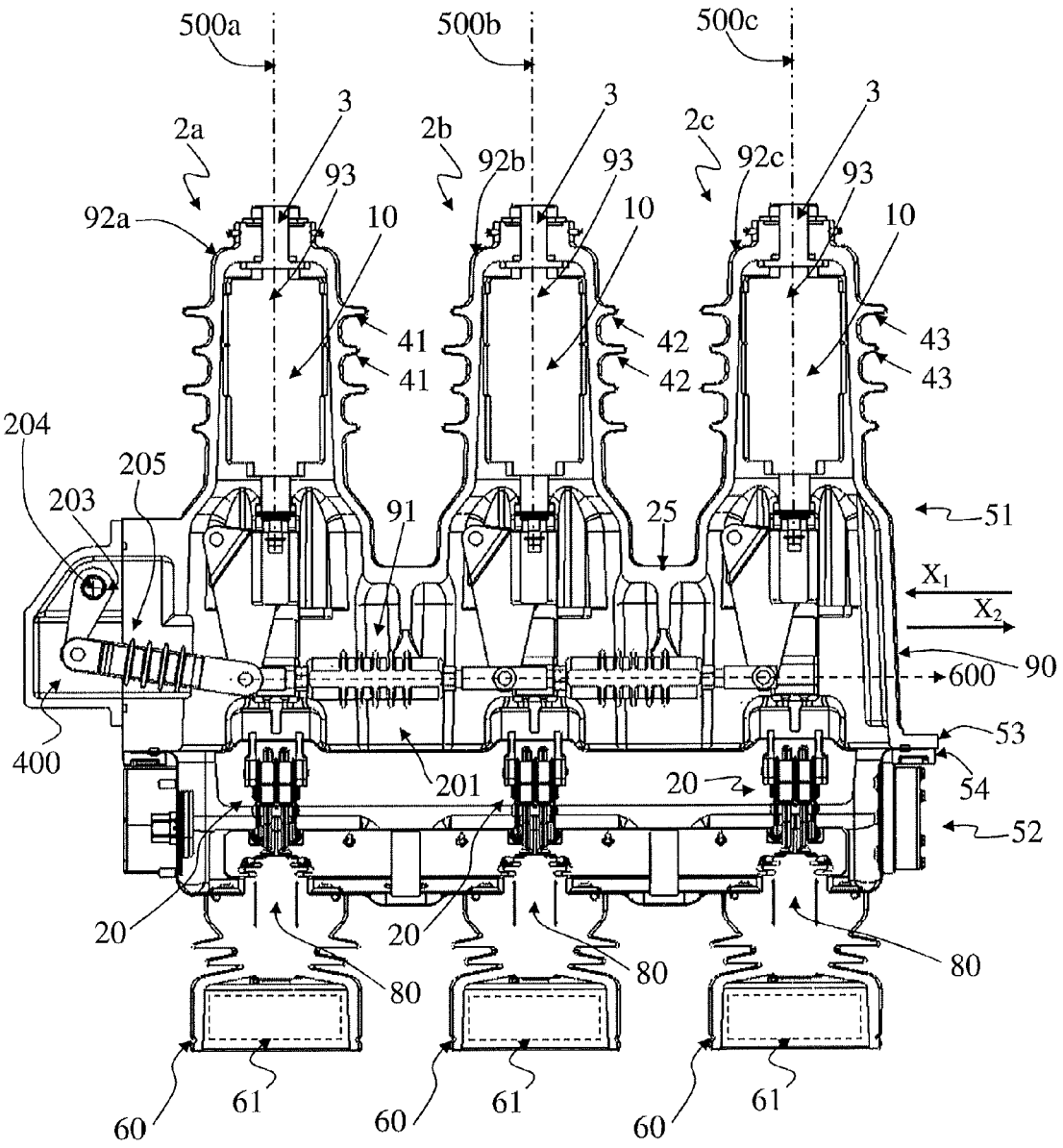
FIG. 5 is a section lateral view of a switching device in accordance with an exemplary embodiment of the present disclosure.
Figure 6:
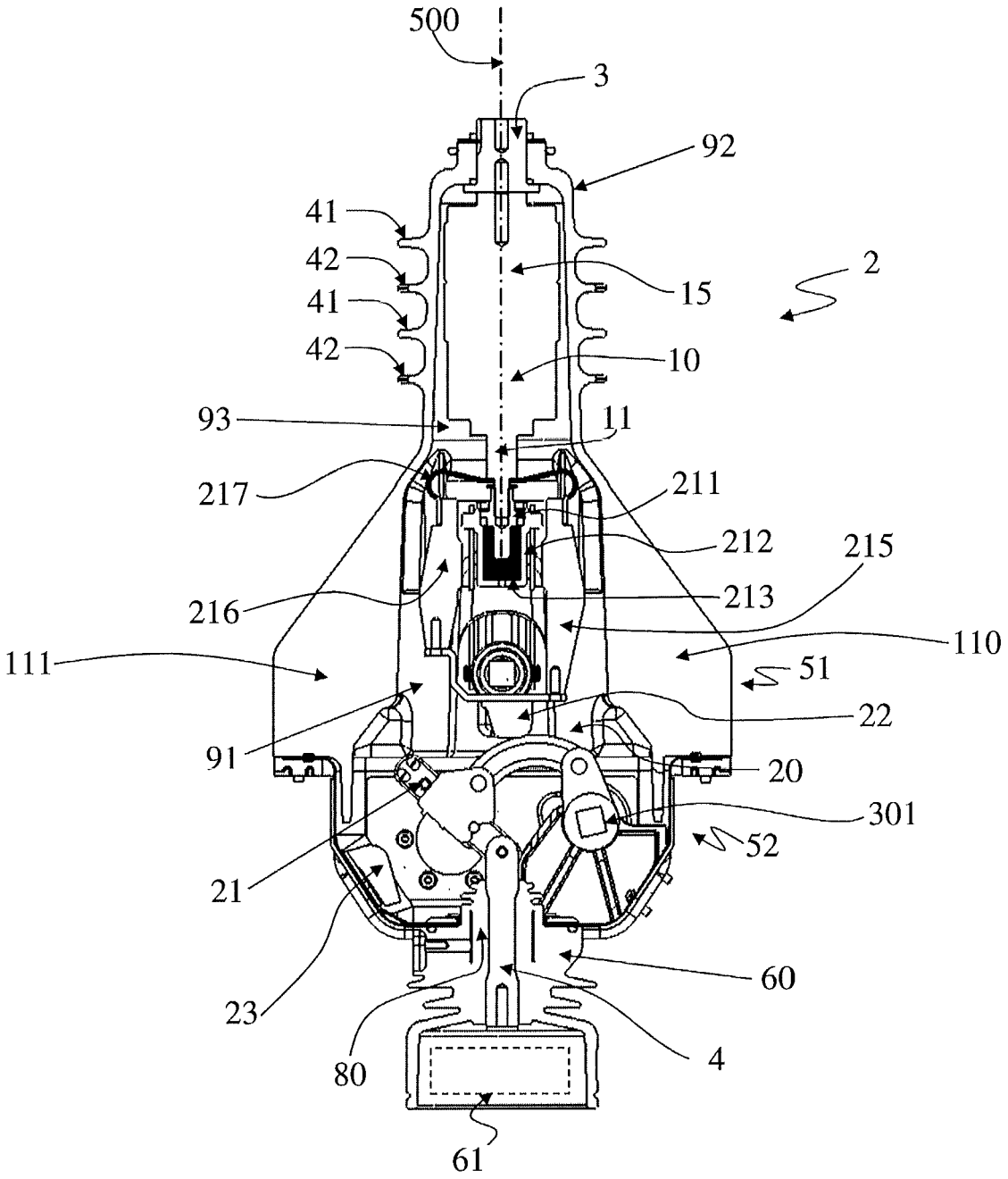
FIG. 6 is a sectional front view of an electric phase of the switching device of FIG. 5 in accordance with an exemplary embodiment of the present disclosure.
Figure 7:
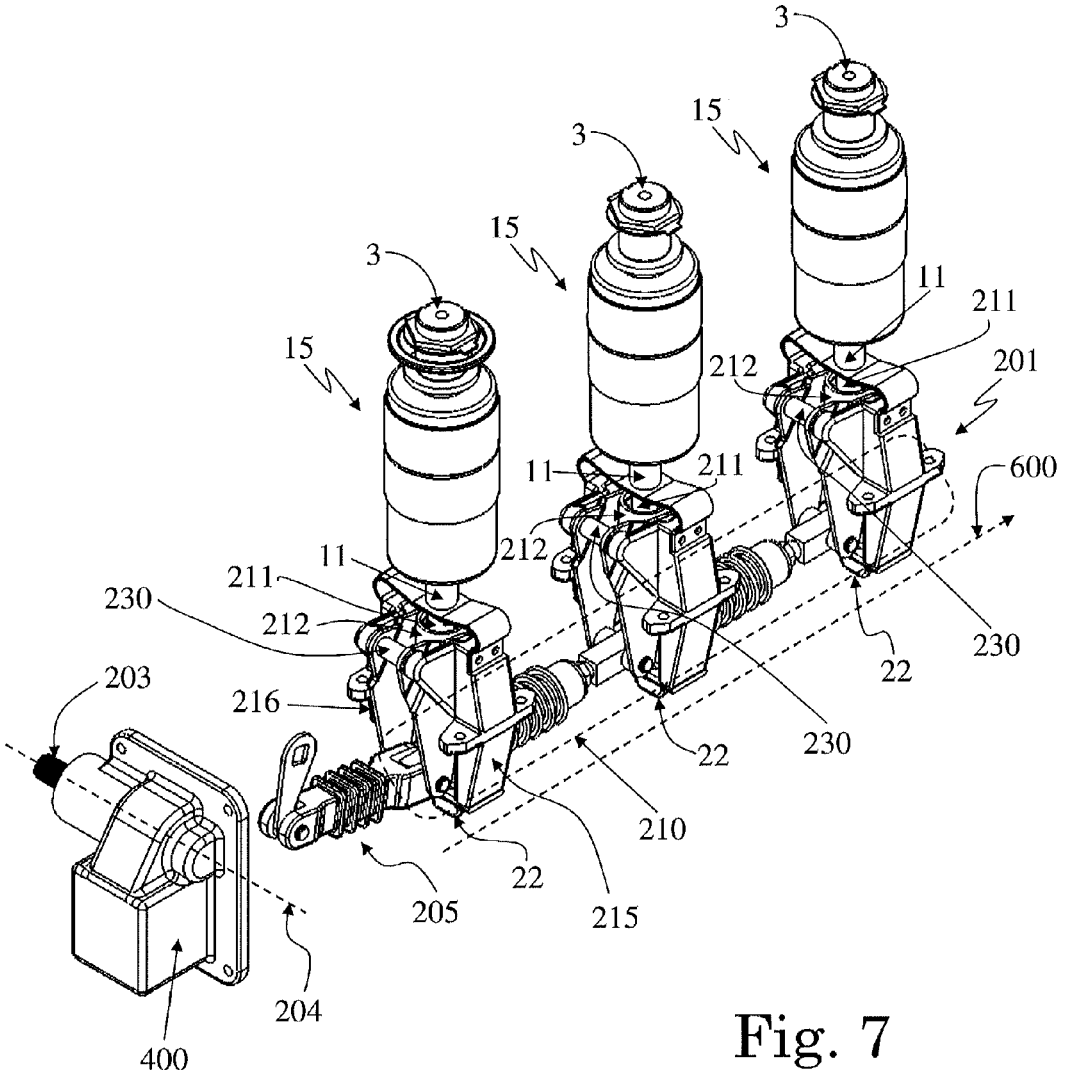
FIG. 7 shows a first kinematic chain of the switching device of FIG. 5, wherein the circuit breaker units and driving means are associated with such kinematic chain in accordance with an exemplary embodiment of the present disclosure.
Figure 9:
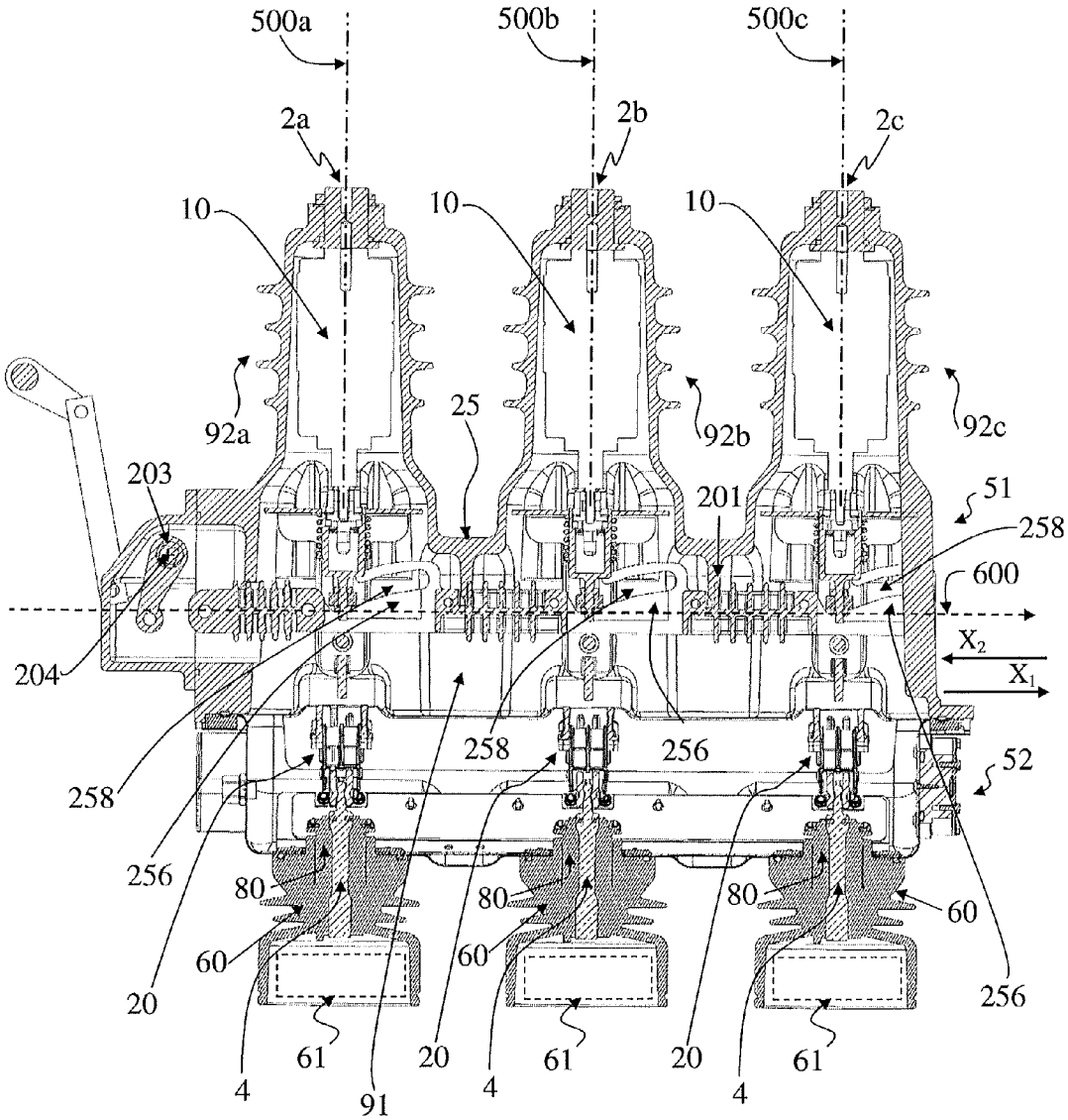
FIG. 9 is a sectional lateral view of a switching device having a second example of kinematic chain associated with its circuit breaker units in accordance with an exemplary embodiment of the present disclosure.
Figure 10:
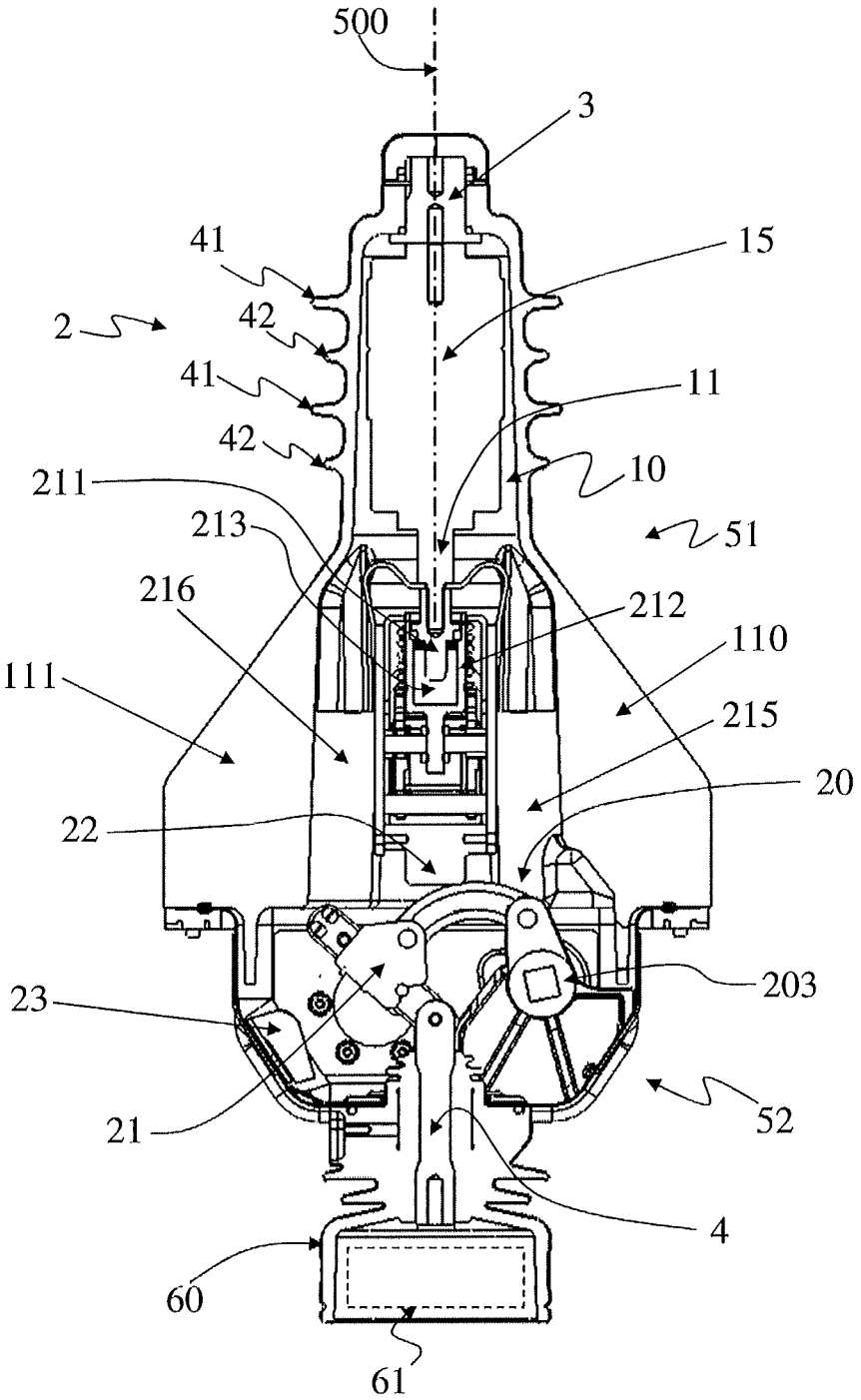
FIG. 10 is a sectional front view of an electric phase of the switching device of FIG. 9 in accordance with an exemplary embodiment of the present disclosure.

FIG. 5 is a section lateral view of a switching device in accordance with an exemplary embodiment of the present disclosure. FIG. 6 is a sectional front view of an electric phase of the switching device of FIG. 5 in accordance with an exemplary embodiment of the present disclosure. FIG. 9 is a sectional lateral view of a switching device having a second example of kinematic chain associated with its circuit breaker units in accordance with an exemplary embodiment of the present disclosure. FIG. 10 is a sectional front view of an electric phase of the switching device of FIG. 9 in accordance with an exemplary embodiment of the present disclosure. As shown in the exemplary embodiments of FIGS. 2-6 and 9-10, an insulator 60 is associated with each disconnector unit 20 of the switching device 1. Such insulator 60 is coupled to the casing 50, in a gas-tight manner, and is adapted to: surround at least a portion of the electric terminal 4 protruding outside from the casing 50; and house one or more sensors (schematically depicted and indicated with numeral reference 61 in Figures) suitable for sensing at least an electrical parameter associated with the current $I_{phase}$ flowing through the electric terminal 4. According to such solution, the one or more sensors 61 are advantageously integrated into the insulator 60.

The switching device 1 comprises first actuating means (schematically depicted and indicated with numeral reference 200 in the example of FIG. 1) which are operatively connected to and adapted to cause the actuation of the movable contact 11 of each circuit breaker unit 10 in the switching device 1, second actuating means (schematically depicted in the example FIG. 1 and indicated with numeral reference 300) which are operatively connected to and adapted to cause the actuation of the movable contact 21 of each disconnector unit 20 associated with a corresponding circuit breaker unit 10.

In another exemplary embodiment, the casing 50 advantageously houses at least a portion of the actuating means 200 and at least a portion of the actuating means 300.

According to still another exemplary embodiment, each phase 2 of the switching device 1 includes earthing means which are operatively associated with the circuit breaker unit 10 or the disconnector unit 20 of such phase 2.

Earthing means operatively associated with the circuit breaker unit 10 are suitable for connecting the first part 100 of the electric circuit 102 to electric earth, by means of the circuit breaker unit 10 itself. Earthing means operatively associated with the disconnector unit 20 are suitable for connecting the second part 101 of the electric circuit 102 to the electric earth, by means of the disconnector unit 20 itself. For example, the earthing means 30 schematically depicted in FIG. 1 are operatively associated with the disconnector unit 20.

Electric discharges or induced currents are avoided (e.g., prevented), or at least reduced, in the earthed part 100 or part 101 of the electric circuit 102, improving the safety of an operator working on such earthed part 100 or 101.

In case that each electric phase 2 of the switching device 1 includes the earthing means 30, the casing 50 advantageously houses also such earthing means 30.

In another exemplary embodiment, the disconnector unit 20 of each electric phase 2 is advantageously arranged to realize also the earthing means 30, e.g., the disconnector unit 20 is arranged in such a way that it can connect, during its operation, the associated part 101 of the electric circuit 102 to the electric earth.

As shown in FIGS. 2-6 and 9-10, the disconnector unit 20 includes an earthing contact 23, e.g., a contact 23 electrically connected to earth, and the movable contact 21 of such disconnector unit 20 can be actuated between the connection position and a first disconnection position, where the movable contact 21 is disconnected from the corresponding fixed contact 22 and the earthing contact 23, a second disconnection position, or earthing position, where the movable contact 21 is disconnected from the corresponding fixed contact 22 and connected to the earthing contact 23.

When the movable contact 21 is in the earthing position, the associated part 101 of the electric circuit 102 is electrically connected to the earthing contact 23 by means of the electric connection provided by the movable contact 21 and the electric terminal 4.

The metal shell 52 of the casing 50 is earthed, e.g., it is connected to electric earth so as to perform a metal earthed segregation between the first and second parts 100, 101 of the electric circuit 102. According to this embodiment, the earthing contact 23 is connected to the metal shell 52; for example, the earthing contact 23 can be mounted on a corresponding portion of the metal shell 52 (as illustrated in the exemplary embodiment of FIG. 4).

According to the exemplary embodiment shown in FIGS. 3-4, the metal shell 52 is suitable for at least: supporting the movable contact 21 and housing the earthing contact 23 of each disconnector unit 20 of the switching device 1; housing the actuating means 300 operatively connected to and adapted to cause the actuation of each associated movable contact 21.

In the exemplary embodiment of FIGS. 3-4, the metal shell 52 includes a main portion 70 having a base wall 71; a front wall 72 and a rear wall 73 protruding transversally from two opposed ends of the base wall 71; first and second parallel lateral walls 74, 75 protruding transversally from the base wall 71 so as to link the first and second front walls 72, 73. The upper ends of the front and rear walls 72, 73 and of the lateral walls 74, 75 are configured to define an overall flanged upper edge (globally indicated by the numeral reference 76).

The metal shell 52 further includes the flanged portion 54 which is placed on and fixed to the flanged upper edge 76.

The flanged portion 54 is fixed to the corresponding flanged portion 53 of the insulating shell 51, so as to define the overall casing 50. Through holes 55, 56 and 77 are defined across the flanged portion 53, the flanged portion 54 and the upper flanged edge 76, respectively. Such through holes 55, 56 and 77 are defined so as to be aligned to each other when the flanged portion 54 is in contact with the upper flanged edge 76, and the flanged portion 53 of the insulating shell 51 is in contact with the flanged portion 54 (FIGS. 3-4). In this way, a screw can be inserted in each hole defined by the alignment of three through holes 55, 56, 77, so as to mutually fix the first and metal shells 51, 52.

Three through openings 80 are defined in the base wall 71 allowing the free passage into the casing 50 of three electric terminals 4; such three electric terminals 4 are connected to the three disconnector units 20 of the electrical phases 2*a*, 2*b*, 2*c*.

Three insulators 60 are coupled to the base wall 71 at the three through openings 80, in such a way to keep the gas-tight condition of the overall casing 50. Each terminal 4 is surrounded outside the metal shell 52 by a corresponding insulator 60.

The movable contact 21 of each disconnector unit 20 is pivotally mounted inside the casing 50 on an upper portion of the corresponding electric terminal 4; in turn the electric terminal 4 and the associated insulator 60 are supported by the base wall 71 of the metal shell 52.

In the exemplary embodiment shown in FIGS. 2-6 and 9-10, the actuating means 300 include a driving shaft 301. The ends of the driving shaft 301 are operatively coupled to the front and rear walls 72, 73 of the metal shell 52 in such a way that the driving shaft 301 is able to rotate about an axis of rotation 302, and in such a manner to keep the gas-tight condition of the overall casing 50. At least an end 303 of the driving shaft 301 is accessible from the external of the metal shell 52, in such a way that it can be operatively connected to means suitable for causing the rotation of the driving shaft 301 about the axis 302.

The driving shaft 301 is positioned inside the metal shell 52 between the movable contacts 21 and the second lateral wall 75. The earthing contacts 23 are fixed to the first lateral wall 74, each one aligned to the movement direction of a corresponding contact 21. The metal shell 52 is connected to electric earth together with the earthing contacts 23 fixed thereto.

The driving shaft 301 is operatively connected to each movable contact 21, through known linking means, in such a way that the rotation of the driving shaft 301 about the axis 302 causes the actuation of each movable contact 21 between the connected position, the first disconnection position and the earthing position.

Figure 11:
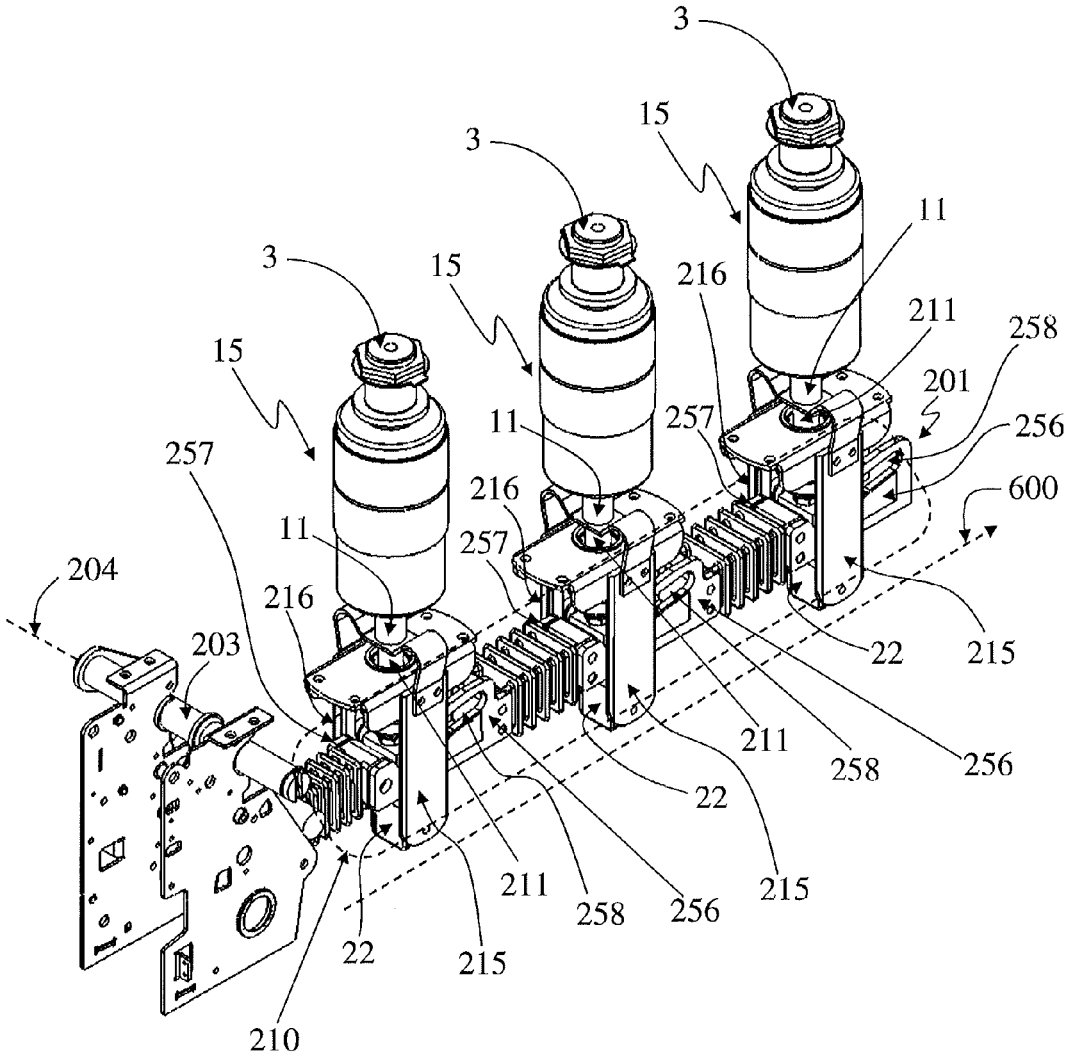
FIG. 11 shows a second kinematic chain of the switching device of FIG. 9, wherein the circuit breaker units and driving means are associated with such kinematic chain in accordance with an exemplary embodiment of the present disclosure.
Figure 12:
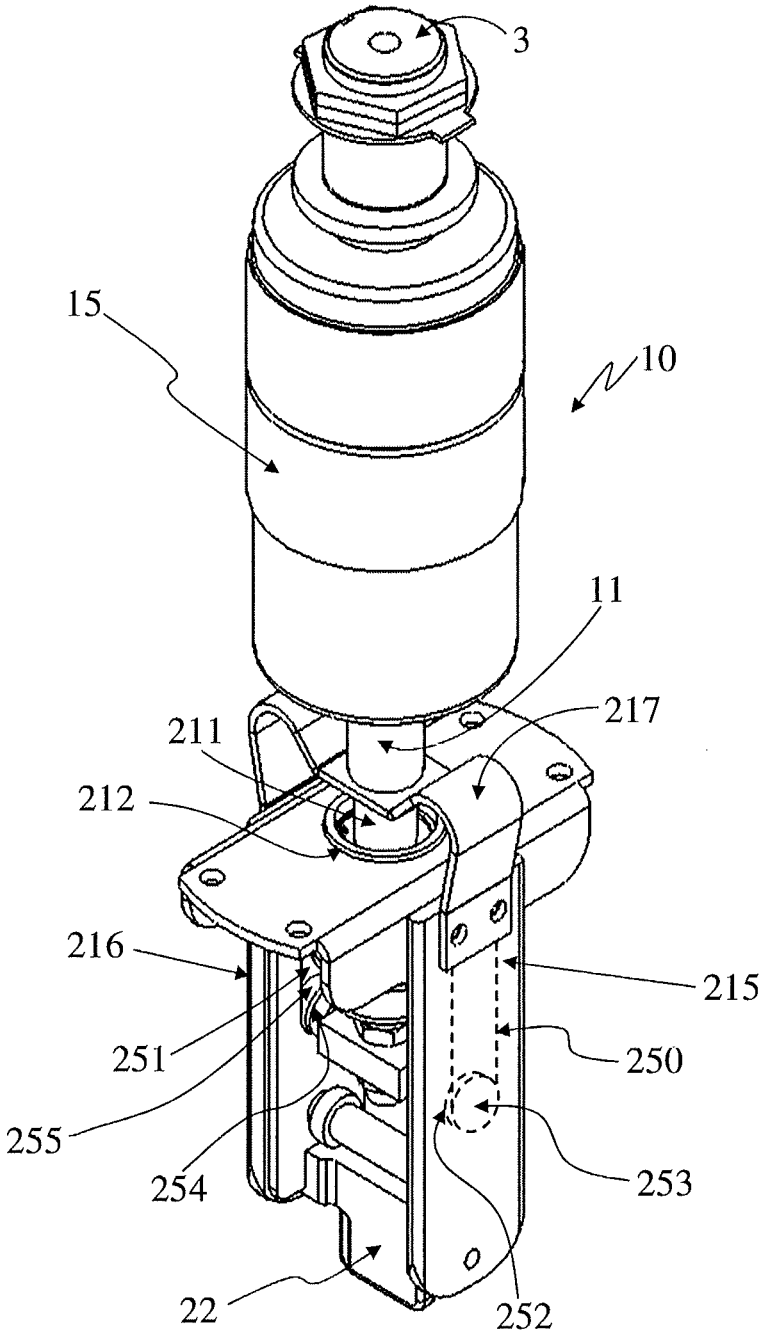
FIG. 12 shows a circuit breaker unit associated with a corresponding portion of the kinematic chain of the switching device of FIG. 9 in accordance with an exemplary embodiment of the present disclosure.

FIG. 11 shows a second kinematic chain of the switching device of FIG. 9, wherein the circuit breaker units and driving means are associated with such kinematic chain in accordance with an exemplary embodiment of the present disclosure. FIG. 12 shows a circuit breaker unit associated with a corresponding portion of the kinematic chain of the switching device of FIG. 9 in accordance with an exemplary embodiment of the present disclosure. As shown in the exemplary embodiments of FIGS. 2, 3 and 5-12, the actuating means 200 associated with each circuit breaker unit 10 in the switching device 1 include a kinematic chain 201 and driving means 203 operatively connected to each other. The kinematic chain 201 is operatively connected to the movable contact 11 of each associated circuit breaker unit 10 and is adapted to be driven by the driving means 203 to cause the actuation of the movable contact 11 between the open and closed positions.

The insulating shell 51 includes a central portion 90 defining an internal main chamber 91 housing at least the kinematic chain 201, an insulating body 92 associated with each electrical phase 2 of the switching device 1, the insulating body 92 protruding from the central portion 90 and defining an internal circuit breaker chamber 93 housing the circuit breaker unit 10 of the associated electric phase 2.

Each circuit breaker chamber 93 can be accessed from the main chamber 91, so the kinematic chain 201 can operatively interact to the movable contact 11 of each circuit breaker unit 10 housed in a corresponding chamber 93 (as illustrated for example in FIGS. 5 and 9).

According to another exemplary embodiment disclosed herein, the insulating shell 51 is advantageously manufactured in a single piece, e.g., the central portion 90 and the one or more insulating bodies 92 protruding therefrom are integral-made during the manufacturing process.

In still another exemplary embodiment shown in FIGS. 2, 3, 5-7 and 9-11, the driving means 203 can include a driving shaft 203 which can rotate about an axis of rotation 204 and which is operatively connected, directly or through linkage means 205, to the kinematic chain 201. The kinematic chain 201 is in turn operatively connected to and adapted to cause the actuation of the movable contact 11 of each circuit breaker unit 10, upon the rotation of the driving shaft 203 about the axis 204.

In yet another exemplary embodiment, an access opening 59 can be defined in the central portion 90 of the insulating shell 51. The switching device 1 can include a cover 400 which is operatively coupled to the central portion 90 to cover the access opening 59 and which is adapted to cover and support the driving shaft 203, such that it can rotate about the axis 204. The access opening 59 allows the free access into the main chamber 91 of the linkage means 205 (of a known type) in order to operatively connect the driving shaft 203 and the kinematic chain 201.

For example, the cover 400 can be coupled to the insulating shell 51 to keep the gas-tight condition of the overall casing 50 and can be made of metal material to better support the driving shaft 203 and withstand the forces generated during the rotation of the shaft 203 itself.

As shown in FIGS. 2, 3, 5-6, and 9-10, the central portion 90 of the insulating shell 51 includes the flanged portion 53, a first front wall 96 and a second front wall 97 which protrudes transversally from opposed ends of the flanged portion 53 in such a way to be faced to each other; first and second parallel lateral walls 98 and 99 which protrude transversally from the flanged portion 53 in such a way to link transversally the first and second front walls 96 and 97.

The accesses opening 59 is defined in the first front wall 96 and the cover 400 is fixed to such wall 96 so as to cover such opening 59 and to support the driving shaft 203.

FIGS. 2, 3 and 5-12 show an exemplary circuit breaker unit 10 that includes a bulb 15 defining an internal sealed environment where the electrical connection/separation between the movable and fixed contacts 11, 12 can occur. The internal space of the bulb 15 is in vacuum; alternatively, such internal space can be filled with insulating gas.

The associated insulating body 92 has a substantially cylindrical shape suitable for defining the internal circuit breaker chamber 93 housing the bulb 15 of the circuit breaker unit 10. A through hole 95 is defined in the upper end of the insulating body 92 to allow the free passage into the circuit breaker chamber 93 of the electric terminal 3 associated with the housed circuit breaker unit 10. For example, the electric terminal 3 passes through the corresponding thorough hole 95 so as to keep the gas-tight condition of the overall casing 50.

In case that the switching device 1 includes at least two electric phases 2, the insulating bodies 92 associated with such phases 2 can protrude from the central portion 90, each along a respective longitudinal axis 500. For example, the longitudinal axes 500 of the insulating bodies 92 lie parallel to each other in a common plane, so that the insulating bodies 92 are aligned to each other.

In the exemplary embodiment shown in FIGS. 2, 3, 5 and 9, the central portion 90 of the insulating shell 51 includes an upper wall 25 linking transversally the first and second lateral walls 98 and 99 (and the first and second front walls 96 and 97). A first insulating body 92*a*, a second insulating body 92*b* and a third insulating body 92*c*, each having substantially a cylindrical shape, are associated with the first, second and third electric phases 2*a*, 2*b* and 2*c*, respectively. Such first, second and third insulating bodies 92*a*, 92*b* and 92*c* protrude transversally from the upper wall 25 along a first longitudinal axis 500*a*, a second longitudinal axis 500*b* and a third longitudinal axis 500*c*, respectively (said first, second and third longitudinal axes 500*a*, 500*b* and 500*c* lying on a common plane, which practically coincides to the sheet of FIGS. 5 and 9). For example, the main insulating bodies 92*a*, 92*b* and 92*c* are aligned to each other, so as the first insulating body 92*a* is placed side by side to the second insulating body 92*b*, which in turn is placed side by side to the third insulating body 92*c*.

A plurality of insulating fins 41, 42 and 43 protrude from the main insulating bodies 92*a*, 92*b* and 92*c*, respectively.

The central portion 90 of the insulating shell 51 includes at least a support tab 110 connecting the first lateral face 98 to the flanged portion 53; and at least a support tab 111 connecting the second lateral face 99 to the flanged portion 53. Such support tabs 110, 111 are suitable for reinforcing the overall structure of the insulating shell 51.

In the exemplary embodiment of FIG. 2 said at least a support tab 110 includes a support tab 110*a* lying in a plane 900 having the longitudinal axis 500*a* of the insulating body 92*a*, a support tab 110*b* lying in a plane 901 having the longitudinal axis 500*b* of the insulating body 92*b*, a support tab 110*c* lying in a plane 902 including the longitudinal axis 500*c* of the insulating body 92*c*, a support tab 110*d* placed between the support tabs 110*a* and 100*b*, and a support tab 110*e* placed between the support tabs 100*b* and 110*d*.

In an exemplary embodiment, at least a support tab 111 includes a support tab aligned to the support tab 110*a* (e.g., lying in the same plane 900 of the support tab 100*a*), a support tab aligned to the support tab 110*b* (e.g., lying in the same plane 901 of the support tan 100*b*), a support tab aligned to the support tab 110*c* (e.g., lying in the same plane 902 of the support tab 110*c*), a support tab aligned to the support tab 110*d* (e.g., lying in the same plane of the support tab 110*d*), and a support tab aligned to the support tab 110*e* (e.g., lying in the same plane of the support tab 110*e*).

According to the exemplary embodiments shown in FIGS. 5-12, the kinematic chain 201 housed in the main chamber 91 of the insulating shell 51 includes a main rod 210 which is operatively connected to the driving means 203 (such as for instance the driving shaft 203 of the illustrated exemplary embodiments).

The main rod 210 is adapted to be driven by the driving means 203 to move linearly into the main chamber 91, along an axis of motion 600.

In an exemplary embodiment of the present disclosure, the main rod 210 is entirely or partially made of insulating material, such as plastic. For example, the main rod 210 can be made of insulating modular components, as illustrated in the exemplary embodiments of FIGS. 7 and 11; such modular components being coupled, e.g., fixed, to each other.

The kinematic chain 201 further includes a movable piston 211 associated with each circuit breaker unit 10 housed in a corresponding circuit breaker chamber 53.

The movable piston 211 can be moved between a first position and a second position. The movable piston 211 is operatively connected to the movable contact 11 of each associated circuit breaker unit 10 in such a way that the movement of the movable piston 211 from the first position to the second position causes the actuation of the movable contact 11 from the closed position to the open position, and the movement from the second position to the first position causes the actuation of the movable contact 11 from the open position to the closed position. For example, the movable piston 211 is directly coupled to a portion of the associated movable contact 11.

The kinematic chain 201 further includes linkage means associated with each movable piston 211. The linkage means operatively connect the associated movable piston 211 to the main rod 210. Such linkage means are adapted to cause the movement of the movable piston 211 from the first position toward the second position when the main rod 210 is moving along the axis of motion 600 in a first direction $X_1$ (FIGS. 5 and 9), and from the second position towards the first position when the main rod 210 is moving along the axis of motion 600 in a second direction $X_2$ (FIGS. 5 and 9), opposed with respect to said first direction $X_1$.

According to the exemplary embodiment of FIGS. 5-8 and to the exemplary embodiment of FIGS. 9-12, the linkage means between the associated movable piston 211 and the main rod 210 include a movable element 212.

The movable element 212 is operatively connected to the main rod 210 to move from a third position to a fourth position upon the movement of such main rod 210 along the axis of motion 600 in the first direction $X_1$, and from the fourth position to the third position upon the movement of the main rod 210 along the axis of motion 600 in the opposed second direction $X_2$.

The movable element 212 is operatively connected to the movable piston 211 through elastic means 213. For example, the movement of the element 212 from the fourth position to the third position is able to cause the movement of the movable piston 211 from the second position to first position and the compression of the elastic means 213.

The compressed elastic means 213 are suitable for applying an elastic force $F_E$, through the movable piston 211, to the movable contact 11 in the closed position. Such elastic force $F_E$ is directed towards the movable contact 11 and has a value calibrated to ensure an adequate contact pressure between the coupled movable and fixed contacts 11, 12.

The movement of the movable element 212 from the third position to the fourth position can cause the movement of the movable piston 211 from the first position to the second position and the return of the compressed elastic means 213 to a rest position.

In the exemplary embodiment of FIGS. 5-8 and in the exemplary embodiment of FIGS. 9-12, the movable piston 211 is fixed, for example, through fastening means, to a portion of the movable contact 11 protruding outside from the bulb 15. The movable element 212 comprises a cup 212 into which a portion of the piston 211 is inserted.

The elastic means 213 are placed between and connected to a bottom wall of the cup 212 and the portion of the movable piston 212 inserted into the cup 12, so as to operatively connect the cup 212 and the movable piston 211. When the cup 212 is in the third position, the elastic means 213 are compressed by the movable piston 211 and apply the elastic force $F_E$ toward the movable contact 11 in the closed position.

According to the exemplary embodiment of FIGS. 5-8 and to the exemplary embodiment of FIGS. 9-12, the linkage means between the main rod 210 and the associated movable piston 211 include a frame having first and second facing support flanks 215 and 216.

The first and second support flanks 215, 216 are made of conductive material and are electrically connected to the movable contact 11 of the associated circuit breaker unit 10 through a contact 217. The contact 217 is flexible and can be connected to the movable contact 11 and can be flexed according to the actuation of the movable contact 11 between the closed and open positions.

The first and second conductive support flanks 215, 216 are connected to the fixed contact 22 of the disconnector unit 20 provided in the same electric phase 2 of the associated circuit breaker unit 10. In this way, the connection in series between the circuit breaker unit 10 and the disconnector unit 20 in the same phase 2 is advantageously realized by the flexible contact 217 and the first and second support flanks 215, 216.

Figure 8:
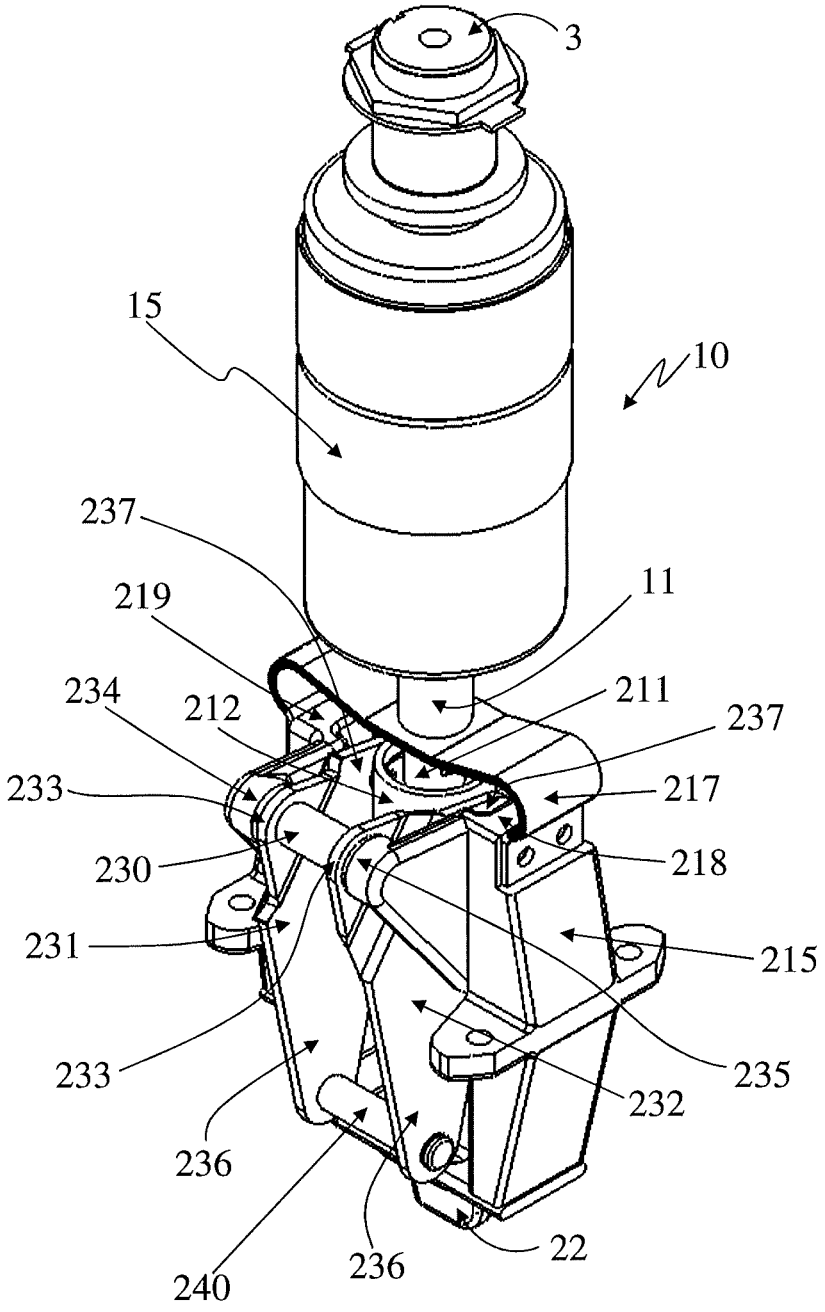
FIG. 8 shows a circuit breaker unit associated with a corresponding portion of the kinematic chain of the switching device of FIG. 5 in accordance with an exemplary embodiment of the present disclosure.

In the exemplary embodiment of FIG. 8 and in the exemplary embodiment of FIG. 12, the ends of the flexible contact 217 are physically and electrically connected to the upper ends 218, 219 of the first and second support flanks 215, 216; the central portion of the flexible contact 217 is interposed between the mutually coupled movable contact 11 and movable piston 211. The bottom ends 220, 221 of the first and second support flanks 215, 216 are linked transversally by the fixed contact 22 of the disconnector unit 20 in the same electric phase 2.

According to the exemplary embodiments shown in FIGS. 5-8, the linkage means between the main rod 210 and the corresponding movable piston 11 further includes a first connecting pin 230 which transversally connect the first and second support flanks 215, 216, a first lever 231 and a second lever 232 each having a fulcrum portion 233 pivotally connected to a first end 234 and an opposed second end 235 of the first connecting pin 230, respectively, wherein each of the first and second levers 231, 232 has a first arm 236 and a second arm 237 protruding from the fulcrum portion 233, a second connecting pin 240 which transversally connects the first arms 236 of the first and second levers 231 and 232.

The second connecting pin 240 is connected to the main rod 210 and the second arms 237 are connected to the movable cup 212.

Due to the connection between the connecting pin 240 and the main rod 210 each of the first and second levers 231, 232 rotates about its fulcrum portion 233 upon the movement of the main rod 210 along the axis of motion 600.

Due to the connection between the second arms 237 and the movable cup 212, the rotation of the first and second levers 231, 232 caused by the movement of the main rod 210 in the first direction $X_1$ along the axis 600 (FIG. 5) causes the movement of the movable cup 212 from the third position to the fourth position. Such movement of the of the movable cup 212 in turn causes a corresponding movement of the movable piston 211 from the first position to the second position and, therefore, the actuation of the movable contact 11 of the circuit breaker unit 10 from the closed position to the open position.

The rotation of the first and second levers 231, 232 caused by the movement of the main rod 210 in the second direction $X_2$ along the axis 600 (FIG. 5) causes the movement of the movable cup 212 from the fourth position to the third position. Such movement of the movable cup 212 in turn causes a corresponding movement of the movable piston 211 from the second position to the first position and, therefore, the actuation of the movable contact 11 of the circuit breaker unit 10 from the open position to the closed position.

In the exemplary embodiment of FIGS. 9-12, a first recess 250 (schematically drawn by dot lines in FIG. 12) and a second recess 251 are defined in the first support flank 215 and the second support flank 216, respectively, of the linkage means.

Such linkage means further includes a first sliding pin 252 having an end 253 inserted movable into the first recess 250 and a second sliding pin 254 having an end 255 inserted movable into the second recess 251, a first plate 256 and a second plate 257 which are connected to the main rod 210 and which comprise a first guiding slot 258 and a second guiding slot (not visible in FIGS. 9-12), respectively.

A portion of said first sliding pin 252 is inserted movable into the first guiding slot 258, and a portion of the second sliding pin 253 is inserted movable into the second guiding slot.

The first guiding slot 258 and the second guiding slot are configured to cause the movement of the first and second sliding pins 252, 253 along the corresponding first and second recesses 250, 251 when the main rod 201 is moving along the axis of motion 600.

The first and second sliding pins 254, 255 are operatively connected to the movable cup 212 in such a way that the movement of the first and second sliding pins 254, 255 along the corresponding first and second recesses 250, 251 cause a corresponding movement of the movable cup 212 between the third and fourth positions.

Movement of the main rod 210 in the first direction $X_1$ along the axis of motion 600 (FIG. 9) causes a corresponding movement of the first and second sliding pins 254, 255 into the first and second recesses 250, 251; such movement of the first and second sliding pins 254, 255 causes the movement of the movable cup 212 from the third to the fourth position and therefore the movement of the movable piston 211 from the first to the second position. In this way, the movable contact 11 of the circuit breaker unit 10 is actuated from the closed to the open position.

The movement of the main rod 210 in the second direction $X_2$ along the axis of motion 600 (FIG. 9) causes a corresponding movement of the first and second sliding pins 254, 255 into the first and second recesses 250, 251; such movement of the first and second sliding pins 254, 255 causes the movement of the movable cup 212 from the fourth to the third position and therefore the movement of the movable piston 211 from the second to the first position. In this way, the movable contact 11 of the circuit breaker unit 10 is actuated from the open to the closed position.

Figure 13:
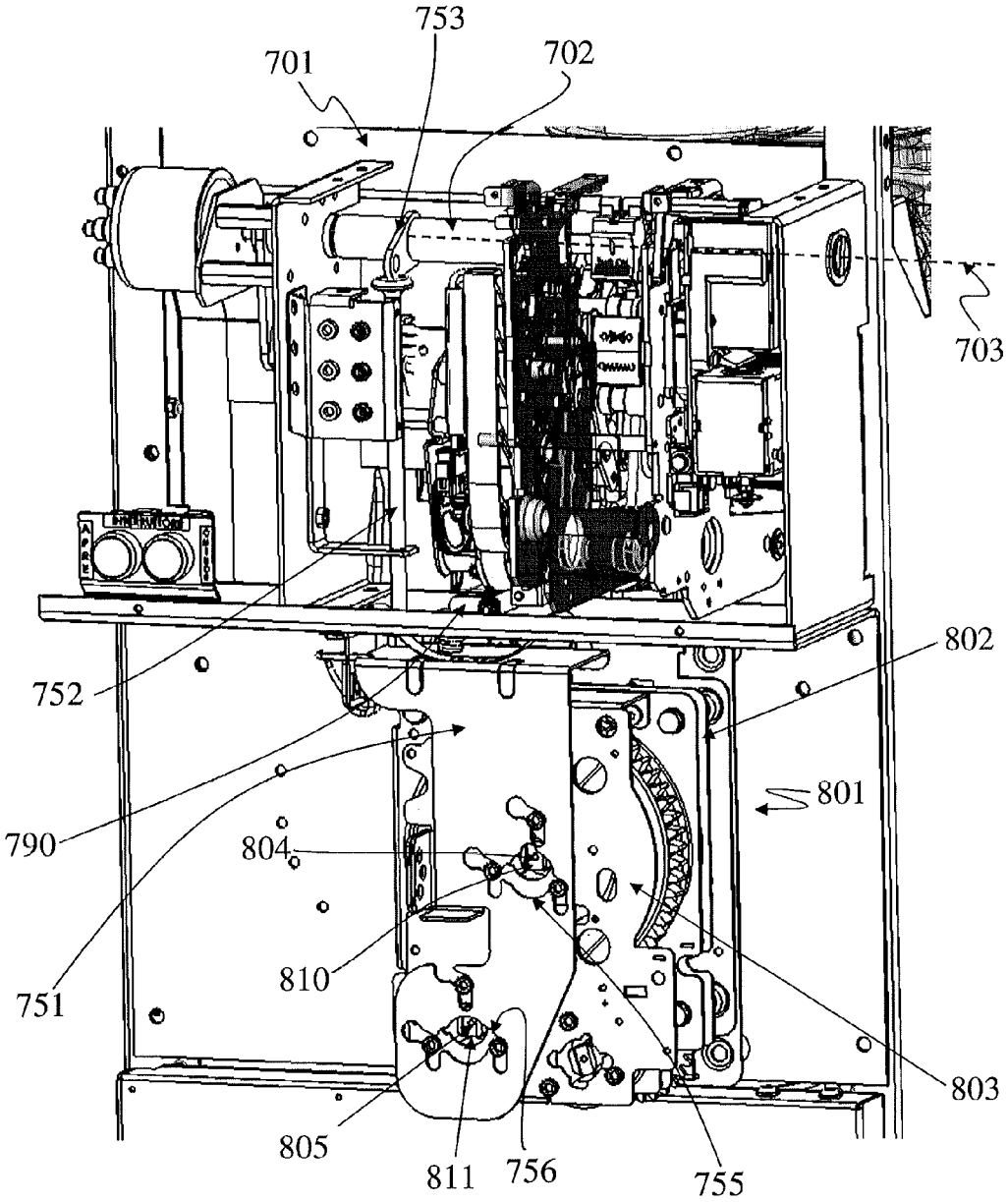
FIG. 13 shows a first operating mechanism and a second operating mechanism connected to a switching device and operatively connected to each other by interlock means, in accordance with an exemplary embodiment of the present disclosure.
Figure 14:
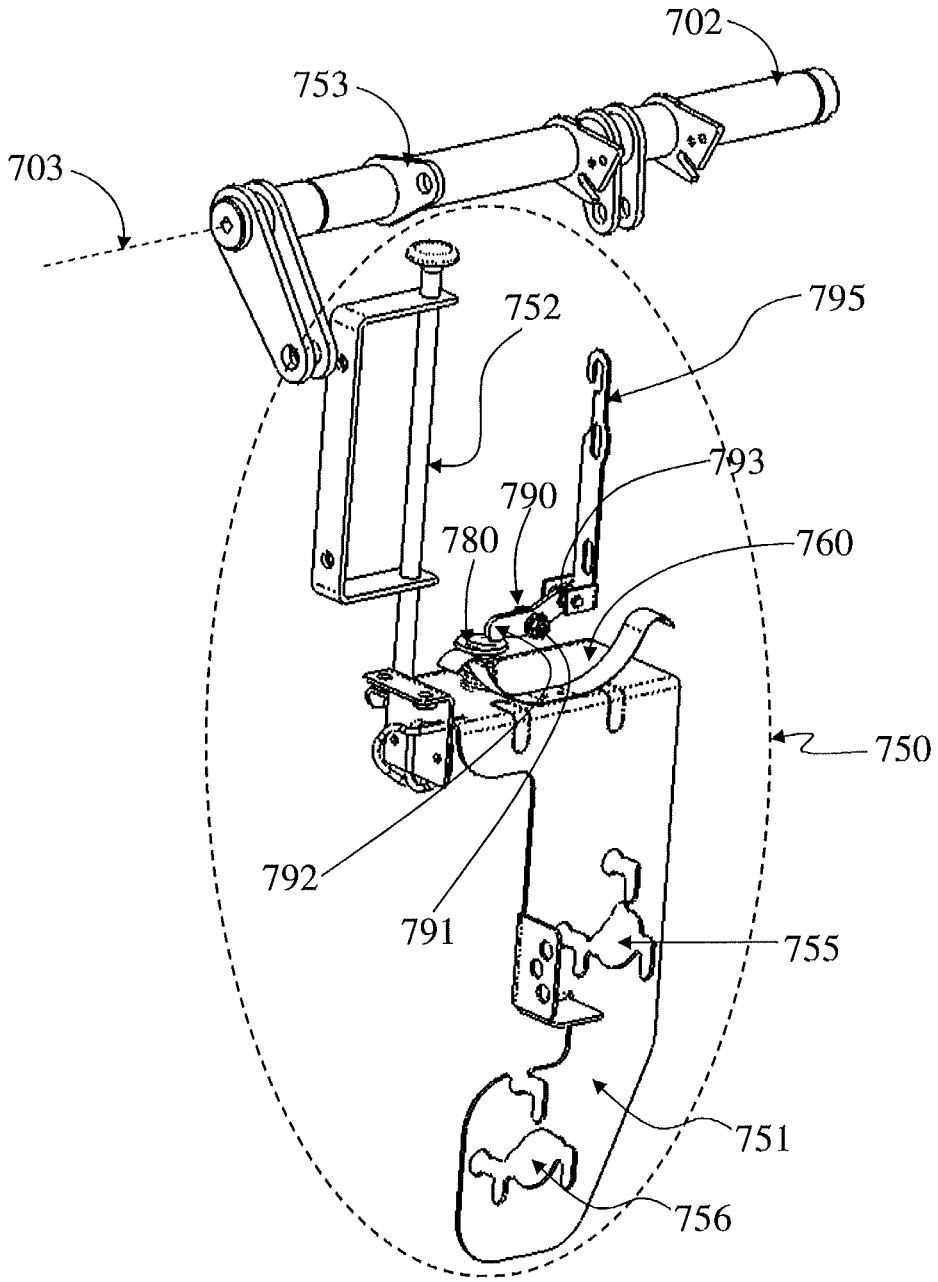
FIG. 14 is a view of the interlock means of FIG. 13 associated with the operating shaft of the first operating mechanism in accordance with an exemplary embodiment of the present disclosure.
Figure 15:
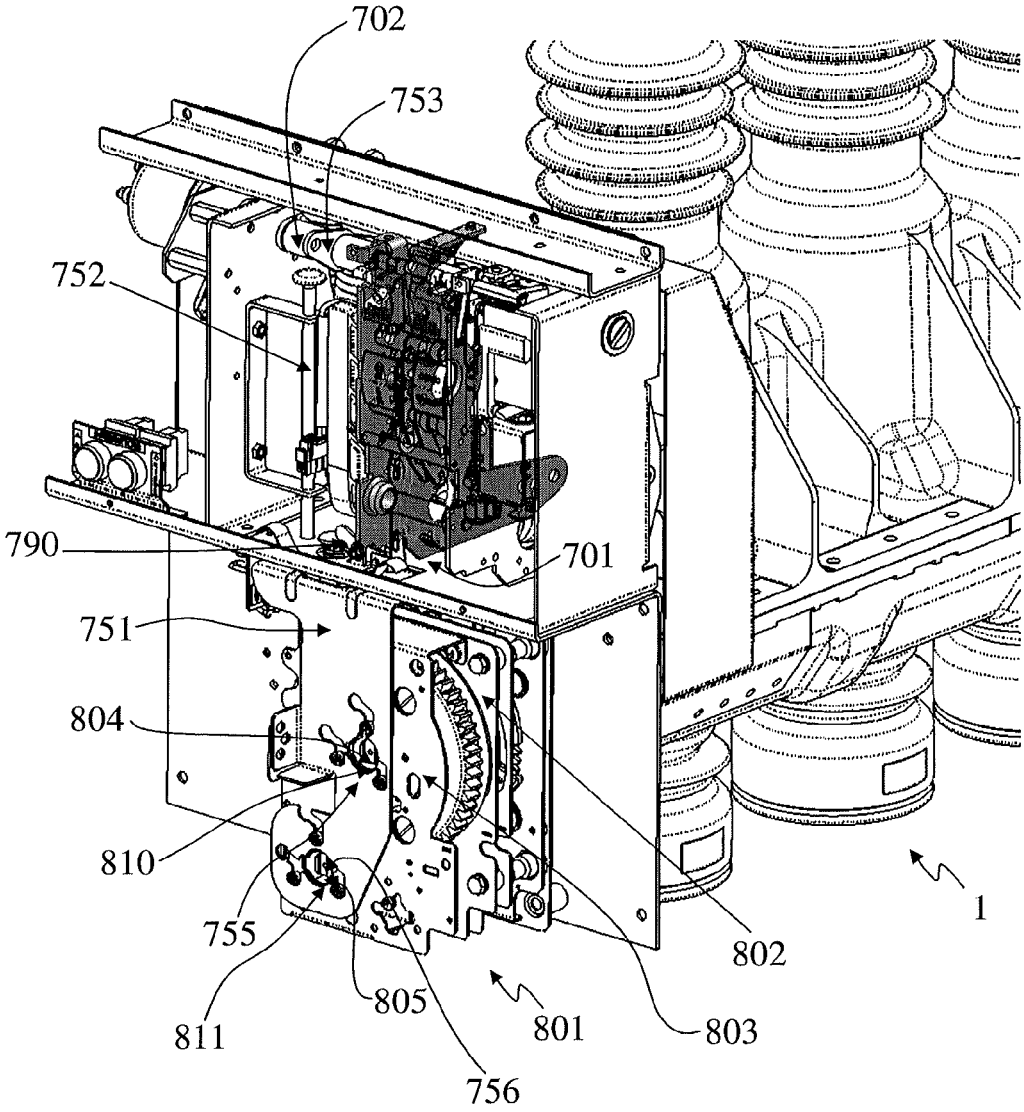
FIG. 15 shows the first and second operating mechanisms and the interlock means of FIG. 13, in accordance with an exemplary embodiment of the present disclosure.

FIG. 13 shows a first operating mechanism and a second operating mechanism connected to a switching device and operatively connected to each other by interlock means, in accordance with an exemplary embodiment of the present disclosure. FIG. 14 is a view of the interlock means of FIG. 13 associated with the operating shaft of the first operating mechanism in accordance with an exemplary embodiment of the present disclosure. FIG. 15 shows the first and second operating mechanisms and the interlock means of FIG. 13, in accordance with an exemplary embodiment of the present disclosure. As shown in FIGS. 13-15, an electric apparatus 700 includes the switching device 1 as already described. The electric apparatus 700 can also include a first operating mechanism 701 operatively connected to and adapt to drive the actuating means 200 of the switching device 1 to cause the actuation of the movable contact 11 of each circuit breaker unit 10 of the switching device 1 itself, a second operating mechanism 801 operatively connected to and adapted to drive the actuating means 300 of the switching device 1 to cause the actuation of the movable contact 21 of each disconnector unit 20 associated with a corresponding circuit breaker unit 10.

In practice, the first operating mechanism 701 is suitable for providing the energy specified for the actuation of each movable contact 11, wherein such energy is transmitted to the movable contact 11 through the actuating means 200.

The second operating mechanism 801 is suitable for providing the energy specified for the actuation of each movable contact 21, wherein such energy it transmitted to the movable contact 21 through the actuating means 300.

For instance, the first operating mechanism 701 and the second operating mechanism 801 are of the known type used for operating circuit breakers and disconnectors. Therefore, only the elements of such first and second operating mechanism 701, 801 which are necessary to understand further characteristics and solutions according to the present disclosure are herein introduced and briefly described in the following.

In the exemplary embodiment of FIGS. 13-15, the operating mechanism 701 includes an operating shaft 702 suitable for rotating about an axis of rotation 703. The operating shaft 702 is operatively connected, through known linkage means, to the driving means 203 of the switching device 1. For example, the rotation of the operating shaft 702 about the axis 703 is suitable for operating such driving means 203 and, hence, for actuating the movable contact 11 of each circuit breaker unit 10 through the kinematic chain 201.

The operating shaft 702 can be operatively connected to the driving shaft 203 of the illustrated exemplary embodiment to cause with its rotation about the axis 703 a corresponding rotation of such driving shaft 203 about the axis 204. For example, the rotation of the operating shaft 702 in a first rotational direction causes a corresponding rotation of the driving shaft 203 about the axis 204. Such rotation of the driving shaft 203 drives the kinematic chain 201 and causes the actuation of the movable contact 11 from the closed to the open position. The rotation of the operating shaft 702 in the first rotational direction can be caused by a manual intervention of an operator on the first actuating mechanism 701, or by an intervention of an opening actuator, due for example to the occurrence of a fault in the electric circuit where the electric apparatus 700 is installed.

The rotation of the operating shaft 702 about the axis 703 in a second rotational direction, opposed with respect to the above mentioned first rotational direction, causes a corresponding rotation of the driving shaft 203 about the axis 204. Such rotation of the driving shaft 203 drives the kinematic chain 201 and causes the actuation of the movable contact 11 from the open position to the closed position.

In the exemplary embodiment shown in FIGS. 13-15, the operating mechanism 801 is of the type disclosed in patent application EP2249360. For example, such operating mechanism 801 has an internal volume defined by a base plate 802 and a front plate 803 and includes a first operating shaft 804 and a second operating shaft 805 which are operatively connected to the actuating means 300 of the switching device 1 through known linkage solutions. The actuation of the first operating shaft 804 and the actuation of the second operating shaft 805 are suitable for operating such actuating means 300 and, hence, for actuating the movable contact 21 of each disconnector unit 20 of the switching device 1.

The actuation of the first operating shaft 804 is suitable to cause, through the actuating means 300, the actuation of the movable contact 21 between the connection position and the first disconnection position, while the actuation of the second operating shaft 805 is suitable to cause, through the actuating means 300, the actuation of the movable contact 21 between the first disconnection position and the earthing position.

For example, the operating shafts 804 and 805 are operatively connected to the end 303 of the driving shaft 301 (accessible form the metal shell 52 as shown in FIG. 4), to cause, by means of their actuation, a corresponding rotation of the driving shaft 301 about the axis 302. The rotation of the driving shaft 301 caused by the first operating shaft 804 is able to cause the actuation of the movable contact 22 between the connection position and the first disconnection position; and the rotation of the driving shaft 301 caused by the second operating shaft 805 can cause the actuation of the movable contact 22 between the first disconnection position and the earthing position.

A first access hole 810 and a second access hole 811 are defined through the front plate 803 to provide access to an end of the first operating shaft 804 and of the second operating shaft 805, respectively, in order to allow the actuation of such first and second operating shafts 804, 805. The first operating shaft 804 and the second operating shaft 805 can be connected to an operating handle for the manual actuation thorough the access holes 801 and 811, respectively.

The electric apparatus 700 can include interlocking means 750 operatively connected to the first and second operating mechanisms 701, 801 and adapted to avoid (e.g., prevent) the driving of the actuating means 300 by the operating mechanism 801, when the movable contact 11 of each circuit breaker unit 10 of the switching device 1 is in the closed position.

According to an exemplary embodiment of the present disclosure the interlocking means 750 includes a covering plate 751 which is operatively associated with the operating mechanism 801 and which can be moved between a covering position where it avoids (e.g., prevents) the access to the operating mechanism 801 to cause the driving of the actuating means 300, and an access position where it allows the access to the operating mechanism 801, an interlock element 752 placed on the covering plate 751, so as it can move together the covering plate 751.

As such, the first operating mechanism 701 includes a blocking element 753 which is operatively connected to the actuating means 200 in such a manner as to be movable between: a blocking position corresponding to the movable contact 11 in the closed position; and an operation position corresponding to the movable contact 11 in the open position.

The blocking element 753 in the blocking position is able to contact the interlock element 752 of the covering plate 751 in the covering position and block the covering plate 751 in such covering position. The blocking element 753 in the operation position is disengaged from the corresponding interlock element 752 of the covering plate 751 in the covering position, so as to allow the displacement of such covering plate 751 towards the access position.

In the exemplary embodiment shown in FIG. 13, the covering plate 751 in the covering position covers a portion of the access hole 810 and a portion of the second access hole 811 of the operating mechanism 801, to avoid (e.g., prevent) the actuation of the respective first and second operating shafts 804 and 805.

A first through hole 755 and a second through hole 756 are defined across the covering plate 751 in such a way to be aligned with the first access hole 810 and the second access hole 811, respectively, when the covering plate 741 is in the access position.

With reference to the exemplary embodiment of FIG. 15, there is no portion of the first access hole 810 and of the second access hole 811 covered by the covering plate 751 when such first and second access holes 810, 811 are aligned to the first through hole 755 and to the second through hole 756, respectively. As a result, an operator can access and operate the respective first and second operating shafts 804 and 805.

According to the exemplary embodiment of FIGS. 13-15, the operating mechanism 801 is placed below the operating mechanism 701 as the covering plates 751 move towards the operating mechanism 701 during its displacement from the covering position to the access position. The interlocking element 152 is a pin 152 fixed to and protruding from an upper part 760 of the covering plate 750.

The blocking element 753 includes a cam 753 mounted on the operating shaft 702 of the first operating mechanism 701 to be substantially aligned to the movement direction of the corresponding pin 752.

The cam 753 is in the blocking position after that the operating shaft 702 has caused the actuation of the movable contact 11 from the open to the closed position. As illustrated in FIG. 13, the cam 753 in the blocking position contacts and blocks the head of the pin 752, and blocks the operating shaft 702 in a stationary condition. Therefore, the covering plate 750 is blocked in the covering position illustrated in FIG. 13, wherein it partially covers the first and second access holes 801, 810.

The cam 753 reaches the operation position after that the operating shaft 702 has caused the actuation of the movable contact 11 from the closed to the open position. As illustrated in FIG. 15, the cam 753 in the operation position is disengaged from the head of the pin 752 to allow the movement thereof and of the associated covering plate 751. The covering plate 750 is in the access position for accessing holes 801, 810 through the aligned first and second through holes 755 and 756.

According to another exemplary embodiment, the interlocking means 750 can be advantageously adapted also to avoid (e.g., prevent) the driving of the actuating means 200 by the operating mechanism 701, while the movable contact 21 is under actuation by the actuating means 300.

According to the exemplary embodiment of FIGS. 13-15, the interlocking means 750 can include an abutting element 780 placed on the covering plate 751, so as it can move together with the covering plate 751, a lever 790 which can rotate about an own fulcrum portion 791 and which has a first arm 792 and a second arm 793 protruding from such fulcrum portion 791, and a second interlock element 795 which is operatively connected to the second arm 793 and which is operatively associated with one or more corresponding parts of the operating mechanism 701.

The abutting element 780 is able to abut against the first arm 792 of the lever 790 during the movement of the covering plate 751 from the covering position to the access position. Such interaction causes the rotation of the lever 709 about its fulcrum portion 791, and hence the displacement of the second interlock element 795 connected to the second arm 793.

The second interlock element 795 is configured to operatively interact, when the covering plate is in the access position, with the associated one or more parts of the first operating mechanism 701, to avoid (e.g., prevent) the driving of the actuating means 300 by such operating mechanism 701.

As shown in FIGS. 13-15, the abutting element 780 is a rivet 780 protruding from the upper part 760 of the covering plate 760, towards the first operating mechanism 701. The second interlocking mechanism 795 is a hooking element 705.

When the head of the rivet 780 abuts against the first arm 791, due to a displacement of the covering plate 751 from the covering position to the access position, the second arm 792 correspondingly turns down so the hooking element 705 interacts with one or more associated parts of the first operating mechanism 701. Such interaction causes the blocking of the operating mechanism 701.

Figure 16:
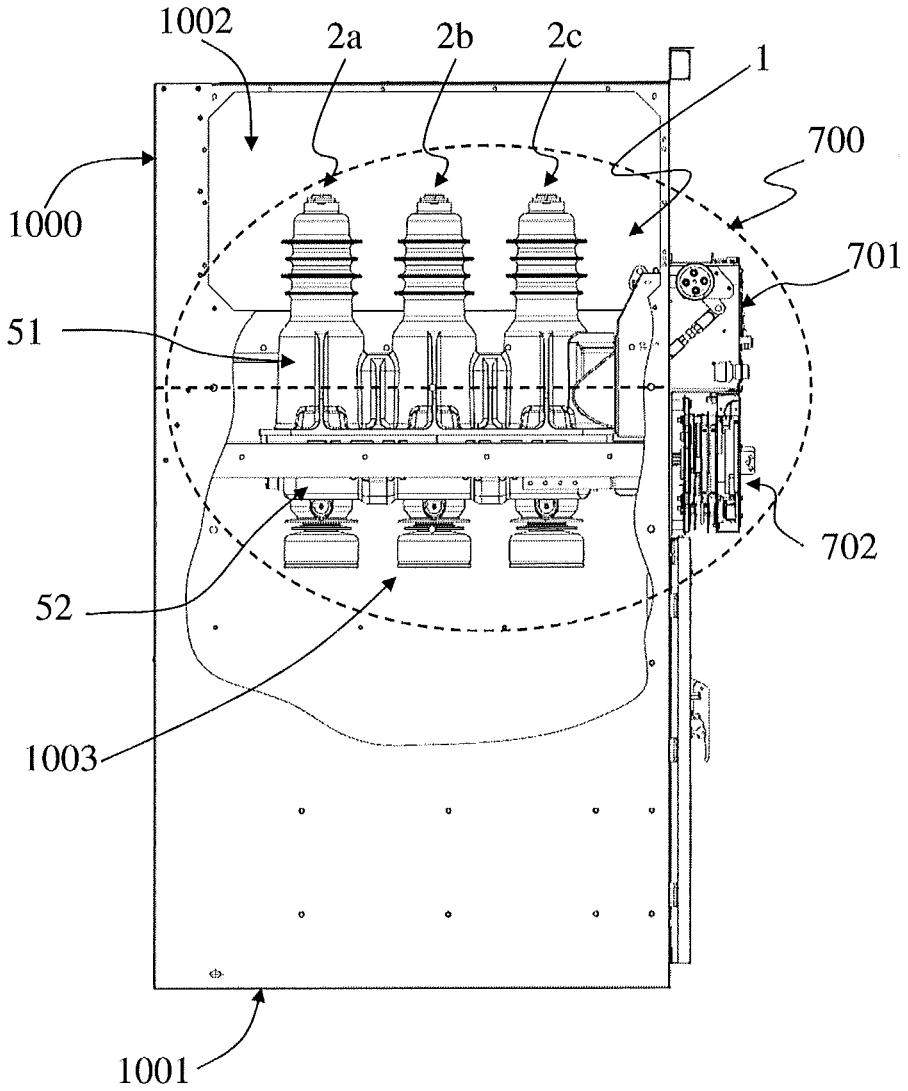
FIG. 16 is a lateral sectional view of a switchgear and of an electric apparatus installed therein in accordance with an exemplary embodiment of the present disclosure.

FIG. 16 is a lateral sectional view of a switchgear and of an electric apparatus installed therein in accordance with an exemplary embodiment of the present disclosure. With reference to FIG. 16, the present disclosure is also related to an electric unit 1000, or switchgear 1000, including at least a switching device 1 and/or at least an electric apparatus 700 according to exemplary embodiments of the present disclosure.

In the exemplary embodiment of FIG. 16, the switchgear 1000 includes a housing 1001 inside which a switching device 1 is installed. Such switching device 1 is placed between an upper compartment 1002, or power distribution compartment 1002, containing the power distribution bars, and a lower compartment 1003, or load compartment 1003, containing the load cables or connections associated with one or more electric loads drawing power from the distribution bars.

The insulating shell 51 of the casing 50 is placed at the power distribution compartment 1002, so the electric terminal 3 associated with each circuit breaker unit 10 can be connected to a corresponding distribution bar. The metal shell 52 of the casing 50 is placed at the load compartment 1003, so the electric terminal 4 associated with each disconnector unit 20 can be connected to a corresponding load cable or connector.

In this way, the casing 50 (for example, the earthed metal shell 52) realizes an earthed metal segregation between the distribution and load compartments 1002, 1003.

As illustrated in FIGS. 13 and 15, the operating mechanism 701 and the operating mechanism 801 are operatively connected to the actuating means 200, 300 of the circuit breaker units 10 and of the disconnector units 20 in the switching device 1, to realize the overall electric apparatus 700 installed in the switchgear 1000.

The first and second operating mechanisms 701, 801 are accessible from the outside of the housing 1001, such that they can be easily operated by an operator to cause the actuation of the circuit breaker units 10 or disconnector units 20 of the switching device 1.

The functional operation of the electric apparatus 700 installed in the switchgear unit 1000 is herein briefly disclosed considering the starting situation wherein the movable contact 11 of each circuit breaker unit 10 is in the closed position with respect to the corresponding fixed contact 12, and wherein the movable contact 21 of each disconnector unit 20 is in the connection position with respect to the corresponding fixed contact 22.

For each current phase 2*a*, 2*b*, 2*c* the flowing of the current $I_{phase}$ is allowed through the electrically coupled movable and fixed contacts 11 and 12 of the circuit breaker unit 10 and through the connected movable and fixed contacts 21 and 22 of the disconnector unit 20. Moreover, for each electric phase 2*a*, 2*b*, 2*c*, the current $I_{phase}$ flows between the electric terminals 3 and 4, and hence between a distribution bar in the upper compartment 1002 and the load cable in the lower compartment 1003.

As illustrated in FIG. 13, in the considered starting situation the covering plate 751 is in the covering position and the cam 753 of the operating shaft 702 is turned down and contacts the head of pin 752.

Since the operating shaft 702 is blocked in a stationary condition, the displacement of the covering plate 751 toward the access position cannot be performed. In this way, the movable contact 21 of each disconnector unit 20 cannot be actuated while the movable contact 11 is in the closed position and the current $I_{phase}$ is flowing.

An intervention on the first actuating mechanism 701 causes a rotation of the operating shaft 702 about the axis 703 and a corresponding rotation of the driving shaft 203 about the axis 204. Such rotation of the driving shaft 203 drives the kinematic chain 201 to actuate the movable contact 11 of each circuit breaker unit 1 from the closed position to the open position, so as to interrupt the flowing of the current $I_{phase}$ through the electrically coupled movable and fixed contacts 11, 12.

Following the rotation of the operating shaft 702 about the axis 703, the cam 753 turns up to disengage the head of the associated pin 752; such situation is illustrated in FIG. 15. In this way, the covering plate 751 is free to be displaced from the covering to the access position, only after the interruption of the current $I_{phase}$ flowing in each electric phase 2*a*, 2*b*, 2*c*.

With reference to FIG. 15, the displacement of the covering plate 751 from the covering to the access position makes possible the actuation of the first and second operating shafts 804 and 805 of the operating mechanism 801 through the respective first and second access holes 810 and 811.

During displacement, firstly an operator can manually actuate the first operating shaft 804 to cause a corresponding rotation of the driving shaft 301 about the axis 302. Such rotation of the driving shaft 301 causes the displacement of the movable contact 21 of each disconnector unit 20 from the connection position to the first disconnection position. Since that in the first disconnection position the fixed and movable contacts 22, 21 are disconnected, a further physical interruption in the electric connection between electric terminals 3 and 4 is provided.

After the actuation of the movable contact 21 from the connection position to the first disconnection position, the operator (keeping the covering plate 751 in the access position) can also manually actuate the second operating shaft 804 to cause a corresponding rotation of the driving shaft 301 about axis 302. Such rotation of the driving shaft 310 causes a further displacement of the movable contact 21 from the first disconnection position to the earthing position. In the earthing position, the movable contact 21 is still disconnected from the corresponding fixed contact 22, and it is connected to the corresponding ground contact 23.

In this way, the load cables connected to each terminal 4 are grounded by means of the disconnector units 20 and the operator can operate in the load compartment 1003 with improved safety.

While the covering plate is kept in the access position by the operator, the hooking element 795 interacts with the associated parts of the operating mechanism 701 in such a manner to prevent the actuation of such operating mechanism 701.

In this way, while the movable contacts 21 of the disconnector units 20 are under actuation by the operating mechanism 801, the movable contacts 11 of the associated circuit breaker units 11 cannot be actuated by the operating mechanism 701, improving the overall safety of the operators working on the switchgear 1000.

In practice, it has been seen how the switching device 1 according to the present disclosure allows achieving the intended object offering some improvements over known solutions.

The single switching device 1 carries out at least the current interruption functionality between parts 100, 101 of the associated electric circuit 102 (through the circuit breaker units 10) and the disconnection functionality between such parts 100, 101 (through the disconnector units 20). The switching device 1 itself also carries out the earthing functionality on one of the parts 100, 101 of the associated electric circuit 102, namely the part associated with one or more electric loads.

By integrating more functionalities in a single device, the overall space occupied into the housing 1001 of a corresponding electric unit, such as the switchgear 1000, is drastically reduced. Further the complex and cumbersome connections between separated electric devices (each realizing only a specific functionality) are avoided (e.g., prevented) by integrating the interruption, disconnection (and even earthing) functionalities in the single switching device 1.

The one or more circuit breaker units 10 (carrying out the interruption functionality) and the one or more disconnector units 20 (carrying out the disconnection functionality) are all housed in a single casing 50 having a compact and at the same time sturdy structure.

Further, the same casing 50 can house the earthing means 30 which carry out the earthing functionality and/or at least a portion of the actuating means 200 and 300 associated with the circuit breaker units 10 and the disconnector units 20, respectively.

Exemplary embodiments described herein can provide advantageous results by defining the casing 50 by coupling the insulating shell 51 and the metal shell 52.

The insulating shell 51 realizes an economical and compact size of the overall casing 50. Since such size is made of insulating material, it is possible to reduce its electrical distance with respect to live parts (e.g., energized parts) in the switchgear 1000, such as the bars in the distribution compartment 1002, thereby further reducing the waste of space into the housing 1001 of the switchgear 1000.

According to the exemplary embodiments previously disclosed, the compact insulating shell 51 is configured to house the circuit breaker units 10 and at least the associated kinematic chain 201 according to a practice and economic solution. By manufacturing the insulating shell 51 in a single piece such advantages are further improved.

The metal shell 52, connected to ground, realizes a size of the overall casing 50 which ensures the respect of relevant Standards (e.g., the specified metal earthed segregation between the distribution compartment 1002 and the load compartment 1003 of the switchgear 100), even if only a single, multifunctional and very compact device, as the switching device 1, is placed between the distribution bars of the distribution compartment 1002 and the load compartment, and even if the insulating shell 51 of such device 1 is placed very close to the distribution bars.

Moreover, all parts/components can be replaced with other technically equivalent elements; in practice, the type of materials, and the dimensions, can be any according to conditions and to the state of the art.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An electric switching device for an electric circuit, comprising:

at least one electric phase including at least one circuit breaking unit and a disconnector unit associated with said at least one circuit breaking unit, said circuit breaker unit having at least one circuit breaker movable contact which can be actuated between a closed position and an open position, wherein in the closed position the at least one circuit breaker movable contact is electrically coupled to a corresponding circuit breaker fixed contact and in the open position is electrically separated from said corresponding circuit breaker fixed contact, said disconnector unit having at least one disconnector movable contact which can be actuated between a connection position and a disconnection position, wherein in the connection position the disconnector movable contact is connected to a corresponding disconnector fixed contact, and in the disconnection position is disconnected from said corresponding disconnector fixed contact;

a casing including a first shell made of insulating material coupled to a second shell made of metal material, said casing configured to house at least the circuit breaker unit and the associated disconnector unit of said at least one electric phase;

first actuating means operatively connected to at least one circuit breaker movable contact for actuating said at least one circuit breaker movable contact;

second actuating means operatively connected to said at least one disconnector movable contact for actuating said at least one disconnector movable contact, wherein said casing houses at least a portion of said first actuating means and at least a portion of said second actuating means, wherein said first actuating means includes a kinematic chain and driving means operatively connected to each other, wherein said kinematic chain is operatively connected to said at least one circuit breaker movable contact and said driving means for actuating said at least one circuit breaker movable contact via said driving means, and wherein said first shell comprises:

a central portion defining an internal main chamber housing at least said kinematic chain; and an insulating body associated with said at least one electric phase, said insulating body protruding from said central portion and defining an internal circuit breaker chamber housing said circuit breaker unit.

2. The switching device according to claim 1, wherein said at least one electric phase includes earthing means operatively associated with one of said circuit breaker unit and said disconnector unit, wherein said earthing means is housed in said casing.

3. The switching device according to claim 2, wherein said disconnector movable contact includes an earthing contact, and said disconnection position of the disconnector movable contact includes:

a first disconnection position where the disconnector movable contact is disconnected from the corresponding disconnector fixed contact and from said earthing contact; and a second disconnection position where the disconnector movable contact is disconnected from the corresponding disconnector fixed contact and connected to said earthing contact.

4. The switching device according to claim 1, comprising:

at least one electric terminal operatively connected to said disconnector unit and protruding from said casing for connecting said disconnector unit to a corresponding portion of said electric circuit; and an insulator coupled to said casing and adapted to: surround at least a portion of said electric terminal, and house one or more sensors configured to sense at least an electrical parameter associated with current (Iphase) flowing through said electric terminal.

5. The switching device according to claim 1, wherein said driving means includes a driving shaft configured to rotate about an axis of rotation and which is operatively connected to said kinematic chain, wherein said kinematic chain is operatively connected to said at least one circuit breaker movable contact and adapted to cause actuation said at least a circuit breaker movable contact upon the rotation of said driving shaft about said axis of rotation; and wherein an access opening is defined in said central portion of the first shell.

6. The switching device according to claim 5, comprising:

a cover operatively coupled to said central portion to cover said access opening, said cover being adapted to cover and support said driving shaft.

7. The switching device according to claim 1, wherein said central portion of the first shell includes:

a flanged portion coupled to said second shell;

first and second parallel lateral walls protruding transversally from said flanged portion;

at least a first support tab connecting said first lateral wall to said flanged portion; and at least a second support tab connecting said second lateral wall to said flanged portion.

8. The switching device according to claim 1, wherein said kinematic chain includes:

a main rod operatively connected to said driving means and adapted to be driven by said driving means to move linearly into said main chamber along an axis of motion;

a movable piston associated with said circuit breaker unit and configured to be moved between a first position and a second position, said movable piston being operatively connected to said at least one circuit breaker movable contact of the associated circuit breaker unit such that movement of the movable piston from the first position to the second position actuates the circuit breaker movable contact from the closed position to the open position, and movement of the movable piston from the second position to the first position actuates the circuit breaker movable contact from the open position to the closed position; and linkage means that operatively connect said movable piston to said main rod, said linkage means being configured for causing movement of said movable piston from said first position toward said second position when the main rod moves along said axis of motion in a first direction, and from said second position towards said first position when the main rod moves along said axis of motion in a second direction that is opposite to said first direction.

9. The switching device according to claim 8, wherein said linkage means includes a movable element which is:

operatively connected to said main rod to move from a third position to a fourth position upon movement of said main rod along the axis of motion in said first direction, and from said fourth position to said third position upon movement of said main rod along the axis of motion in said second direction; and operatively connected to said movable piston through elastic means, wherein movement of said movable element from the fourth position to the third position moves said movable piston from the second position to the first position and the compression of said elastic means, and the movement of said movable element from said third position to said fourth position moves said movable piston from the first position to the second position and the return of said compressed elastic means to a rest position.

10. The switching device according to claim 9, wherein said linkage means includes:

a frame having first and second facing support flanks transversally connected by a first connecting pin;

a first lever and a second lever each having a fulcrum portion pivotally connected to a first end and an opposed second end of said first connecting pin, respectively, wherein each of said first and second levers has a first arm and a second arm protruding from said fulcrum portion; and a second connecting pin which transversally connects the first arms of said first and second levers and which is connected to said main rod, wherein the second arms of the first and second levers are connected to said movable element.

11. The switching device according to claim 10, wherein the first and second support flanks are made of conductive material and are connected to the fixed disconnector contact of said disconnector unit, wherein a flexible conductor electrically connects said first and second support flanks to the circuit-breaker movable contact.

12. The switching device according to claim 9, wherein said linkage means includes:

a frame having first and second facing support flanks, wherein a first recess and a second recess are defined in said first support flank and in said second support flank, respectively;

a first sliding pin having an end movably inserted into said first recess and a second sliding pin having an end movably inserted into said second recess, said first and second sliding pins being operatively connected to said movable element so that movement of said first and second sliding pins along the corresponding first and second recesses causes a corresponding movement of the movable element between said third and fourth positions;

a first plate and a second plate which are connected to said main rod and which include a first guiding slot and a second guiding slot, respectively, wherein a portion of said first sliding pin is movably inserted into said first guiding slot and a portion of said second sliding pin is movably inserted into said second guiding slot; and said first guiding slot and said second guiding slot being configured to cause movement of said first and second sliding pins along the corresponding first and second recesses when the main rod is moving along said axis of motion.

13. An electric apparatus, comprising:

a switching device having:

at least one electric phase including at least one circuit breaking unit and a disconnector unit associated with said at least one circuit breaking unit, said circuit breaker unit having at least one circuit breaker movable contact which can be actuated between a closed position and an open position, wherein in the closed position the at least one circuit breaker movable contact is electrically coupled to a corresponding circuit breaker fixed contact, and in the open position is electrically separated from said corresponding circuit breaker fixed contact, said disconnector unit having at least one disconnector movable contact which can be actuated between a connection position and a disconnection position, wherein in the connection position the disconnector movable contact is connected to a corresponding disconnector fixed contact and in the disconnection position is disconnected from said corresponding disconnector fixed contact;

a casing including a first shell made of insulating material coupled to a second shell made of metal material, said casing configured to house at least the circuit breaker unit and the associated disconnector unit of said at least one electric phase;

first actuating means operatively connected to at least one circuit breaker movable contact for actuating said at least one circuit breaker movable contact; and second actuating means operatively connected to said at least one disconnector movable contact for actuating said at least one disconnector movable contact;

wherein said casing houses at least a portion of said first actuating means and at least a portion of said second actuating means, wherein said first actuating means includes a kinematic chain and driving means operatively connected to each other, wherein said kinematic chain is operatively connected to said at least one circuit breaker movable contact and said driving means for actuating said at least one circuit breaker movable contact via said driving means, and wherein said first shell comprises:

a central portion defining an internal main chamber housing at least said kinematic chain; and an insulating body associated with said at least one electric phase, said insulating body protruding from said central portion and defining an internal circuit breaker chamber housing said circuit breaker unit;

a first operating mechanism operatively connected to and adapted to drive said first actuating means of the switching device to cause the actuation of said at least one circuit breaker movable contact of the circuit breaker unit;

a second operating mechanism operatively connected to and adapted to drive said second actuating means of the switching device to cause the actuation of said at least one disconnector movable contact of the disconnector unit; and interlocking means operatively connected to said first and second operating mechanisms and adapted to prevent the driving of said second actuating means by the second operating mechanism, when said at least one circuit breaker movable contact is in the closed position.

14. The electric apparatus according to claim 13, wherein said interlocking means are adapted to prevent the driving of said first operating means by the first operating mechanism, when said at least one disconnector movable contact is under actuation by said second actuating means.

15. The electric apparatus according to claim 13, wherein said interlocking means includes:

a covering plate operatively associated with said second operating mechanism and which can be moved between a covering position where said covering plate prevents access to said second operating means to cause the driving of said second operating means, and an access position where said covering plate allows access to said second operating mechanism;

an interlock element placed on said covering plate; and wherein said first operating mechanism comprises:

a blocking element which is operatively connected to said first actuating means to be movable between a blocking position corresponding to said at least one circuit breaker movable contact in the closed position and an operation position corresponding to said at least one circuit breaker movable contact in the open position, said blocking element wherein in the blocking position is configured to contact the interlock element of the covering plate in the covering position and block the covering plate in said covering position.

16. The electric apparatus according to claim 13, wherein said interlocking means includes:

an abutting element placed on said covering plate;

a lever configured to rotate about an associated fulcrum portion and which has a first arm and a second arm protruding from said associated fulcrum portion; and a second interlock element which is operatively connected to said second arm and which is operatively associated with one or more corresponding parts of said first operating mechanism, wherein said abutting element is configured to abut against said first arm during movement of the covering plate from the covering position to the access position, and wherein said second interlock element is configured to operatively interact, when the covering plate is in the access position, with said corresponding one or more parts of the first operating mechanism to avoid the driving of said first actuating means by said first operating mechanism.

17. A switchgear comprising:

at least one switching device including at least one electric phase having at least one circuit breaking unit and a disconnector unit associated with said at least one circuit breaking unit, said circuit breaker unit having at least one circuit breaker movable contact which can be actuated between a closed position and an open position, wherein in the closed position the at least one circuit breaker movable contact is electrically coupled to a corresponding circuit breaker fixed contact, and in the open position is electrically separated from said corresponding circuit breaker fixed contact, said disconnector unit having at least one disconnector movable contact which can be actuated between a connection position and a disconnection position, wherein in the connection position the disconnector movable contact is connected to a corresponding disconnector fixed contact and in the disconnection position is disconnected from said corresponding disconnector fixed contact;

a casing including a first shell made of insulating material coupled to a second shell made of metal material, said casing configured to house at least the circuit breaker unit and the associated disconnector unit of said at least one electric phase;

first actuating means operatively connected to at least one circuit breaker movable contact for actuating said at least one circuit breaker movable contact;

second actuating means operatively connected to said at least one disconnector movable contact for actuating said at least one disconnector movable contact, wherein said casing houses at least a portion of said first actuating means and at least a portion of said second actuating means, wherein said first actuating means includes a kinematic chain and driving means operatively connected to each other, wherein said kinematic chain is operatively connected to said at least one circuit breaker movable contact and said driving means for actuating said at least one circuit breaker movable contact via said driving means, and wherein said first shell comprises:

a central portion defining an internal main chamber housing at least said kinematic chain; and an insulating body associated with said at least one electric phase, said insulating body protruding from said central portion and defining an internal circuit breaker chamber housing said circuit breaker unit.

18. A switchgear comprising:

at least one electric apparatus including a switching device having:

at least one electric phase including at least one circuit breaking unit and a disconnector unit associated with said at least one circuit breaking unit, said circuit breaker unit having at least one circuit breaker movable contact which can be actuated between a closed position and an open position, wherein in the closed position the at least one circuit breaker movable contact is electrically coupled to a corresponding circuit breaker fixed contact, and in the open position is electrically separated from said corresponding circuit breaker fixed contact, said disconnector unit having at least one disconnector movable contact which can be actuated between a connection position and a disconnection position, wherein in the connection position the disconnector movable contact is connected to a corresponding disconnector fixed contact, and in the disconnection position is disconnected from said corresponding disconnector fixed contact;

a casing including a first shell made of insulating material coupled to a second shell made of metal material, wherein said casing is configured to house at least the circuit breaker unit and the associated disconnector unit of said at least one electric phase;

first actuating means operatively connected to at least one circuit breaker movable contact for actuating of said at least one circuit breaker movable contact;

second actuating means operatively connected to said at least one disconnector movable contact for actuating said at least one disconnector movable contact, wherein said casing houses at least a portion of said first actuating means and at least a portion of said second actuating means, wherein said first actuating means includes a kinematic chain and driving means operatively connected to each other, wherein said kinematic chain is operatively connected to said at least one circuit breaker movable contact and said driving means for actuating said at least one circuit breaker movable contact via said driving means, and wherein said first shell comprises:

a central portion defining an internal main chamber housing at least said kinematic chain; and an insulating body associated with said at least one electric phase, said insulating body protruding from said central portion and defining an internal circuit breaker chamber housing said circuit breaker unit;

a first operating mechanism operatively connected to and adapted to drive said first actuating means of the switching device to cause the actuation of said at least one circuit breaker movable contact of the circuit breaker unit;

a second operating mechanism operatively connected to and adapted to drive said second actuating means of the switching device to cause the actuation of said at least one disconnector movable contact of the disconnector unit; and interlocking means operatively connected to said first and second operating mechanisms and adapted to avoid the driving of said second actuating means by the second operating mechanism, when said at least one circuit breaker movable contact is in the closed position.

* * * * *